US009051110B2

(12) United States Patent
Gatto et al.

(10) Patent No.: US 9,051,110 B2
(45) Date of Patent: Jun. 9, 2015

(54) PACKAGING FOR MEDICINE FOR CLINICAL TRIALS OR COMMERCIAL USE

(71) Applicant: Celgene Corporation, Summit, NJ (US)

(72) Inventors: Michael Gatto, Rockaway, NJ (US); Lisa MacNeir, Clinton, NJ (US)

(73) Assignee: Celgene Corporation, Summit, NJ (US)

( * ) Notice: Subject to any disclaimer, the term of this patent is extended or adjusted under 35 U.S.C. 154(b) by 0 days.

(21) Appl. No.: 14/054,637

(22) Filed: Oct. 15, 2013

(65) Prior Publication Data

US 2014/0102934 A1 Apr. 17, 2014

Related U.S. Application Data

(60) Provisional application No. 61/714,536, filed on Oct. 16, 2012, provisional application No. 61/830,259, filed on Jun. 3, 2013.

(51) Int. Cl.
*B65D 85/42* (2006.01)
*B65D 77/02* (2006.01)
(Continued)

(52) U.S. Cl.
CPC ..... *B65D 85/42* (2013.01); *B65D 77/003* (2013.01); *B65D 81/133* (2013.01); *B65B 5/024* (2013.01); *B65D 77/02* (2013.01); *B65D 77/042* (2013.01);
(Continued)

(58) Field of Classification Search
CPC .... B65D 77/003; B65D 77/02; B65D 77/042; B65D 77/0426; B65D 81/133; B65D 85/42; B65D 2201/00
USPC ..... 206/446, 590–593, 736, 745, 756–765, 206/769–774, 807; 229/125.01
See application file for complete search history.

(56) References Cited

U.S. PATENT DOCUMENTS 1,951,831 A 3/1934 Lewis
2,274,253 A 2/1942 Howell
(Continued)

FOREIGN PATENT DOCUMENTS

DE 20321788 U1 2/2010
FR 1407142 A 7/1965
FR 2864825 A1 * 7/2005

OTHER PUBLICATIONS

MWV: Dosepak® Unit-Dose Medication Packaging [online]. MeadWestvaco Corporation. [retrieved on Oct. 2, 2012]. Retrieved from the internet: <URL:www.meadwestvaco.com/HealthcarePackagingSolutions/AdherencePackaging/MWV021898>.
(Continued)

*Primary Examiner* — Bryon Gehman
(74) *Attorney, Agent, or Firm* — Jones Day

(57) ABSTRACT

A package for receiving a vial may include an inner portion folded into a first shape configured to receive the vial; an outer portion folded into a second shape configured to removably receive the first shape of the inner portion; and an identifying mark or label disposed on the inner portion and viewable when the inner portion is disposed within the outer portion. The inner portion may include top, bottom, and first and second side portions that define a first aperture configured to receive the vial, and a top flap securable to the top or first or second side portions so as to retain the vial within the first aperture. A second aperture defined in the top flap may permit access to contents of the vial without removing the vial from the inner portion, e.g., may have a diameter selected to permit the vial top to protrude therethrough.

33 Claims, 35 Drawing Sheets

(51) Int. Cl.

| | |
|---|---|
| ***B65D 81/133*** | (2006.01) |
| ***B65D 77/00*** | (2006.01) |
| ***B65B 5/02*** | (2006.01) |
| ***B65D 77/04*** | (2006.01) |

(52) U.S. Cl.
CPC ..... *B65D 77/0426* (2013.01); *B65D 2201/00* (2013.01)

(56) References Cited

U.S. PATENT DOCUMENTS

| | | | | | |
|---|---|---|---|---|---|
| 3,204,759 | A | * | 9/1965 | Palmer | 206/777 |
| 3,240,417 | A | * | 3/1966 | Andreini | 206/592 |
| 3,349,986 | A | * | 10/1967 | Chapman et al. | 206/591 |
| 3,437,194 | A | | 4/1969 | Ames et al. | |
| 3,616,897 | A | * | 11/1971 | Vrana | 206/568 |
| 3,819,036 | A | | 6/1974 | Weldon | |
| 4,109,786 | A | * | 8/1978 | Roccaforte et al. | 206/783 |
| 5,673,796 | A | | 10/1997 | Tulloch | |
| 5,765,693 | A | * | 6/1998 | Gnadt et al. | 206/763 |
| 5,775,505 | A | | 7/1998 | Vasquez et al. | |
| 5,860,526 | A | * | 1/1999 | Burke, Jr. | 206/446 |
| 6,024,224 | A | * | 2/2000 | Gnadt et al. | 206/763 |
| 6,789,678 | B2 | * | 9/2004 | Auclair | 206/590 |
| 7,718,132 | B2 | | 5/2010 | Thomson et al. | |
| 2010/0264058 | A1 | * | 10/2010 | Krause | 206/745 |

OTHER PUBLICATIONS

MWV: Injectapak® Vial/Syringe Packages [online]. MeadWestvaco Corporation, 2012 [retrieved on Oct. 15, 2013]. Retrieved from the internet<URL:www.meadwestvaco.com/HealthcarePackagingSolutions/InjectableDelivery/MWV021911>.

* cited by examiner

PACKAGING FOR MEDICINE FOR CLINICAL TRIALS OR COMMERCIAL USE

CROSS-REFERENCE TO RELATED APPLICATIONS

This application claims the benefit of U.S. Provisional Patent Application No. 61/714,536, filed Oct. 16, 2012 and entitled "Packaging for Clinical Trials," and U.S. Provisional Patent Application No. 61/830,259, filed Jun. 3, 2013 and entitled "Packaging for Clinical Trials," the entire contents of both of which are incorporated by reference herein.

BACKGROUND OF THE INVENTION

1. The Names of the Parties to a Joint Research Agreement

There has been no joint research agreements entered into with any third parties.

2. Field of the Invention

Embodiments of the present invention relate generally to packaging for clinical trials. In particular, embodiments of the present invention are directed to customized packaging for vials (injectable compounds) designed to facilitate labeling and distribution of clinical or commercial supplies.

3. Description of the Related Art

Packaging, and more specifically, packaging of vials, is well known in the art.

There are many challenges related to the packaging of products in vials and pooled supplies. Lined cartons often have issues with size. Also, packaging a pooled supply for vials has its problems in the prior art. A problem also arises when package supplies require an ancillary label at the point of distribution. This is because doing so would require a complete unpackaging of the kit.

Some prior art packagings include a removable dosage unit, which may be removed from an outer pack to prepare the medication. However, the purpose of these prior art packagings is to allow for rapid visual inspection and to be consumer friendly. These prior art packages do not allow for reduced labeling to support clinical trials.

There exists a need for a new package that can allow for reduced labeling to support clinical trials or commercial use.

SUMMARY OF THE INVENTION

Embodiments of the present invention provide a package that can allow for reduced labeling to support clinical trials or commercial use.

Under one aspect, a package for receiving a vial includes an inner portion constructed out of a first piece of material folded into a first shape configured to receive the vial therein; an outer portion constructed out of a second piece of material folded into a second shape configured to removably receive the first shape of the inner portion; and an identifying mark or label disposed on the inner portion and being viewable when the first shape of the inner portion is disposed within the second shape of the outer portion.

In some embodiments, the inner portion includes a top portion, a bottom portion, and first and second side portions that define a first aperture configured to receive the vial, and a top flap securable to at least one of the top portion and the first and second side portions so as to retain the vial within the first aperture, the top flap having defined therein a second aperture configured to permit access to contents of the vial without removing the vial from the inner portion. The second aperture may have a diameter selected to permit a top of the vial to protrude therethrough.

Some embodiments further include a cap protector configured to be disposed over the inner portion and including an indented portion sized to accommodate and protect a top of the vial.

In some embodiments, a side aperture is defined within the side portion of the inner portion, the vial being viewable through the side aperture.

Some embodiments further include one or more tape panels that seal the inner portion in the first shape so as to evidence tampering with the inner portion.

In some embodiments, the outer portion further includes side portions that include cutouts to ease in removal of the inner portion from the outer portion.

In some embodiments, an inside of the first shape of the inner portion includes a vial support configured to stabilize the vial within the inner portion.

In some embodiments, at least one of the inner and outer portions includes a tab, slot, or flap configured to interlock the first shape of the inner portion with the second shape of the outer portion so as to permit partial removal of the inner portion from the outer portion and to inhibit complete removal of the inner portion from the outer portion.

In some embodiments, the inner and outer portions respectively are formed using a single piece of material.

Under another aspect of the present invention, a kit for preparing a package for receiving a vial includes an inner portion that is folded flat and is foldable into a first shape configured to receive the vial therein; and an outer portion that is folded flat and is foldable into a second shape configured to removably receive the first shape of the inner portion. Preferably, the inner portion has an area for receiving an identifying mark or label that is viewable when the inner and outer portions respectively are folded into the first and second shapes and the first shape is disposed within the second shape so as to form the package.

In some embodiments, the first shape into which the inner portion is foldable includes a top portion, a bottom portion, and first and second side portions that define a first aperture configured to receive the vial, and a top flap securable to at least one of the top portion and the first and second side portions so as to retain the vial within the first aperture, the top flap having defined therein a second aperture configured to permit access to contents of the vial without removing the vial from the inner portion. The second aperture may have a diameter selected to permit a top of the vial to protrude therethrough.

Some embodiments further include a cap protector configured to be disposed over the inner portion and including an indented portion sized to accommodate and protect a top of the vial.

In some embodiments, a side aperture is defined within the side portion of the inner portion, the vial being viewable through the side aperture.

Some embodiments further include one or more tape panels for use in sealing the inner portion in the first shape so as to evidence tampering with the inner portion.

In some embodiments, the outer portion further includes side portions that include cutouts to ease in removal of the inner portion from the outer portion.

In some embodiments, an inside of the first shape of the inner portion includes a vial support configured to stabilize the vial within the inner portion.

In some embodiments, at least one of the inner and outer portions includes a tab, slot, or flap configured to interlock the first shape of the inner portion with the second shape of the outer portion so as to permit partial removal of the inner portion from the outer portion and to inhibit complete removal of the inner portion from the outer portion.

In some embodiments, the inner and outer portions respectively are formed using a single piece of material.

Under another aspect of the present invention, a method of packaging a vial includes constructing an inner portion by folding a first piece of material into a first shape configured to receive the vial therein; disposing the vial within the first shape of the inner portion; constructing an outer portion by folding a second piece of material into a second shape configured to removably receive the first shape of the inner portion; and inserting the inner portion into the outer portion. Preferably, the inner portion has an area for receiving an identifying mark or label that is viewable when the inner and outer portions respectively are folded into the first and second shapes and the first shape is disposed within the second shape so as to form a package.

In some embodiments, the inner portion includes a top portion, a bottom portion, and first and second side portions that define a first aperture configured to receive the vial, and a top flap, the method including securing the top flap to at least one of the top portion and the first and second side portions so as to retain the vial within the first aperture, the top flap having defined therein a second aperture permitting access to contents of the vial without removing the vial from the inner portion. In some embodiments, the second aperture has a diameter selected to permit a top of the vial to protrude therethrough.

Some embodiments further include disposing a cap protector over the inner portion, the cap protector including an indented portion sized to accommodate and protect a top of the vial.

In some embodiments, a side aperture is defined within the side portion of the inner portion, the vial being viewable through the side aperture.

Some embodiments further include sealing the inner portion in the first shape using one or more tape panels that evidence tampering with the inner portion.

In some embodiments, the outer portion further includes side portions that include cutouts to ease in removal of the inner portion from the outer portion.

In some embodiments, an inside of the first shape of the inner portion includes a vial support that stabilizes the vial within the inner portion.

Some embodiments further include interlocking the first shape of the inner portion with the second shape of the outer portion with a tab, slot, or flap on at least one of the inner and outer portions so as to permit partial removal of the inner portion from the outer portion and to inhibit complete removal of the inner portion from the outer portion.

In some embodiments, the inner and outer portions respectively are formed using a single piece of material.

Other embodiments of the present invention include packaging including an inner portion that includes a top portion, a bottom portion, and a side portion. The inner portion further includes a top flap, where the top flap includes a small top aperture, and a large top aperture capable of receiving a vial. The packaging further includes an outer portion. The inner portion is constructed out of at least one piece of material, where the one piece of material is folded into a desired shape capable of receiving a vial therein. The inner portion engages with the outer portion such that an identifying mark or label is capable of being viewed on the inner portion, or on a medium included in the inner portion through an aperture on the inner portion, while the inner portion and outer portion are so engaged.

Yet another embodiment of the present invention is directed to a kit for a package including at least three separate components, including: an inner portion; an outer portion; and a cap protector. The inner portion and the outer portion are folded flat, and the inner portion is capable of being refolded into a shape that is capable of receiving a vial therein. The outer portion is capable of being refolded into a shape that is capable of receiving the inner portion therein. Assembly of the package includes engaging the three components of the kit by placing the cap protector on the inner portion, and placing the inner portion within the outer portion, where the cap protector is disposed between a portion of the inner portion and a portion of the outer portion.

Other embodiments of the present invention further include a method of packaging a vial including folding a first component into an inner portion, where the inner portion includes a top portion, a bottom portion, and a side portion. The inner portion further includes a top flap, where the top flap includes a small top aperture, and a large top aperture capable of receiving a vial. The method of packaging a vial further includes folding a second component into an outer portion, inserting a vial into the large top aperture of the inner portion, sealing the vial within the inner portion by closing the top flap, inserting a cap protector on the inner portion, and inserting the inner portion into the outer portion.

Yet another embodiment of the present invention is directed to a package including an inner portion, where the inner portion includes a vial holding portion. The vial holding portion includes a plurality of sides and a hollow space capable of including at least a portion of a vial therein, where at least a portion of a top of the vial is accessible when the vial is disposed in the vial holding portion. The inner portion further includes a cooperating portion capable of slidably engaging with an outer portion, the cooperating portion including a base, a rear, and sides. The sides of the cooperating portion include flaps. The package further includes an outer portion with a front surface, a top surface, a bottom surface, and two side surfaces, where a cavity is formed within the outer portion. A cutout is formed on the side surfaces of the outer portion, which also includes an engagement portion capable of engaging the flaps. The inner portion can be slidingly engaged with the outer portion by being slid into the cavity of the outer portion. The flaps of the inner portion engage with the engagement portion of the outer portion thereby holding the inner portion within the cavity of the outer portion. An area of the sides of the cooperating portion of the inner portion are exposed through the cutout formed on the side surfaces of the outer portion when the inner portion is disposed within the cavity of the outer portion. A user may disengage the inner portion from the outer portion by grabbing the area of the sides of the cooperating portion of the inner portion that is exposed and pulling the inner portion away from the cavity of the outer portion.

Other embodiments of the present invention further include a kit for a package including at least two separate components, where the two separate components include an inner portion and an outer portion. The inner portion and the outer portion are folded flat, and the inner portion is capable of being refolded into a shape that is capable of forming a vial holding portion for receiving a vial therein and a cooperating portion for slidably engaging with the outer portion. The outer portion is capable of being refolded into a shape that is capable of receiving the inner portion in a cavity included in the outer portion. Assembly of the package includes engaging the two components of the kit by sliding the inner portion within the cavity of the outer portion.

Yet another embodiment of the present invention is directed to a method of packaging a vial including folding a first component into an inner portion, where the inner portion includes a vial holding portion with a plurality of sides and a hollow space capable of receiving at least a portion of a vial therein. At least a portion of a top of the vial is accessible when the vial is disposed in the vial holding portion. The inner portion further includes a cooperating portion capable of slidably engaging with an outer portion, the cooperating portion including a base, a rear, and sides, where the sides include flaps. The method of packaging a vial further includes inserting the inner portion into the outer portion.

BRIEF DESCRIPTION OF THE DRAWINGS

Preferred features of embodiments of the present invention are disclosed in the accompanying drawings, wherein similar reference characters denote similar elements throughout the several views, and wherein:

FIGS. 15-20A respectively are front, top, bottom, first side, second side, and rear views of an alternative package, according to an embodiment of the present invention.

DETAILED DESCRIPTION

Figure 1B:
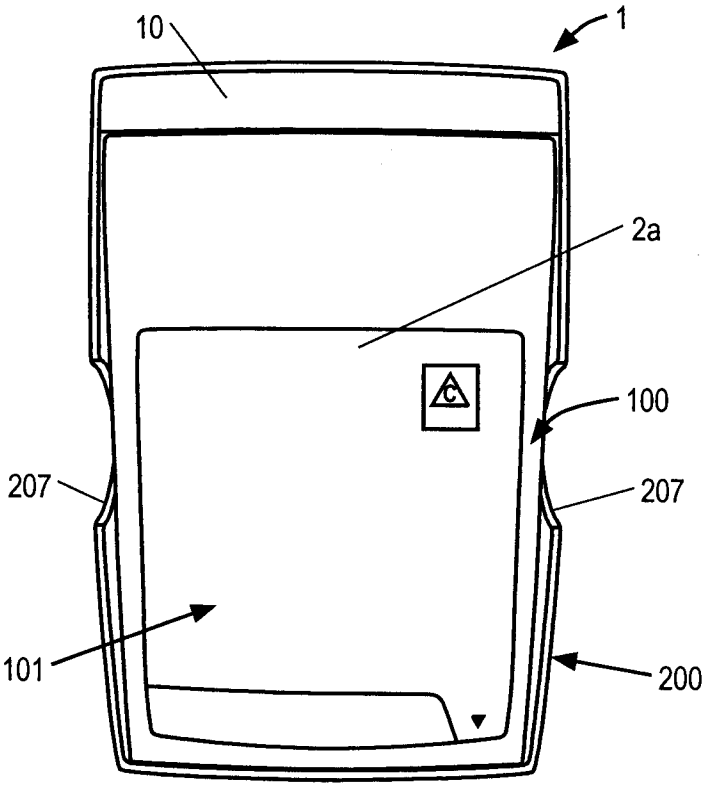
FIGS. 1A and 1B respectively are front views of a package with flat labeling and with booklet labeling, according to an embodiment of the present invention.

Embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the Figures. Additionally, in the following description, it is understood that terms such as "top," "bottom," "side," "front," "back," "inner," "outer," and the like, are words of convenience and are not to be construed as limiting terms.

Packagings of the prior art include vials that are labeled and packaged into an outer carton. In the prior art, the vials are considered the primary container and would need to be unpacked at the point of distribution to be further labeled with any ancillary Annex 13 label that may be required. Thus, the prior art design is not desirable for clinical trials. Additionally, many packagings of the prior art do not include features that allow a person to see the contents of the vials contained therein when the vials are still located in the packagings.

Figure 27:
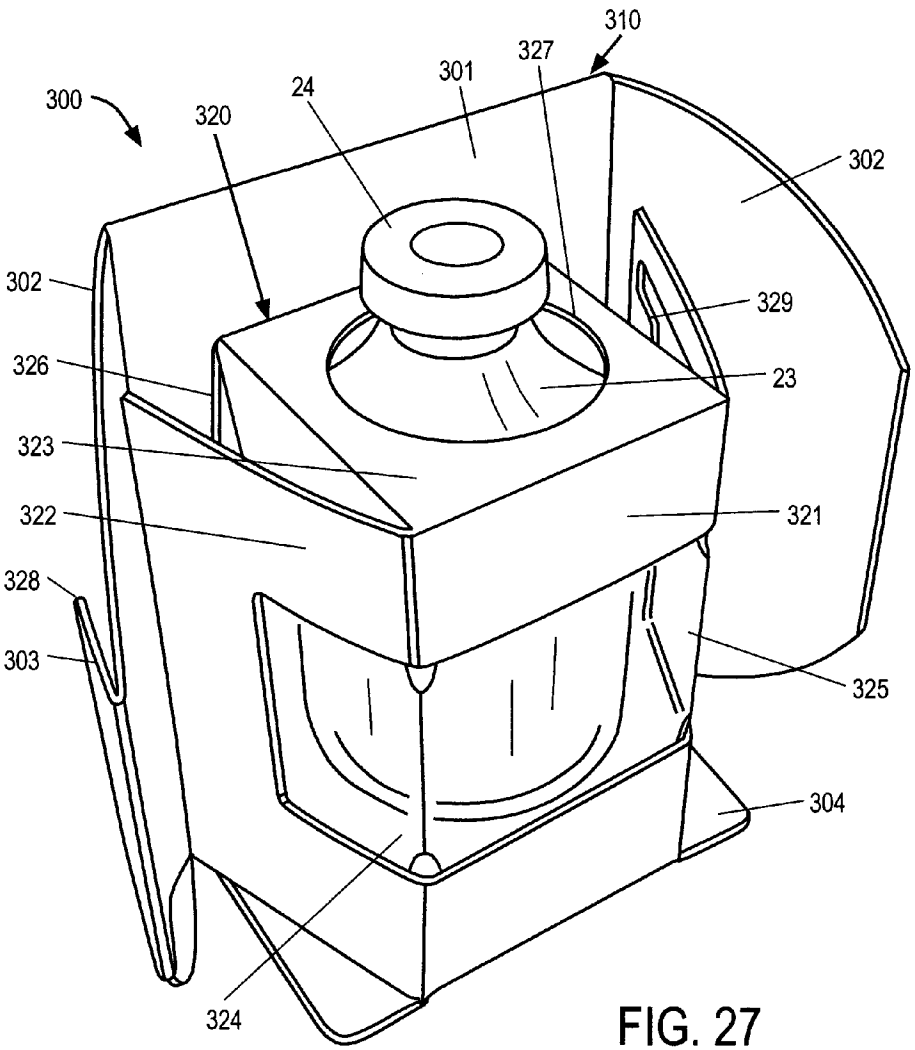
FIGS. 27 and 28 both are top/side perspective views of an inner portion of an alternative package having a vial disposed therein, according to an embodiment of the present invention.
Figure 28:
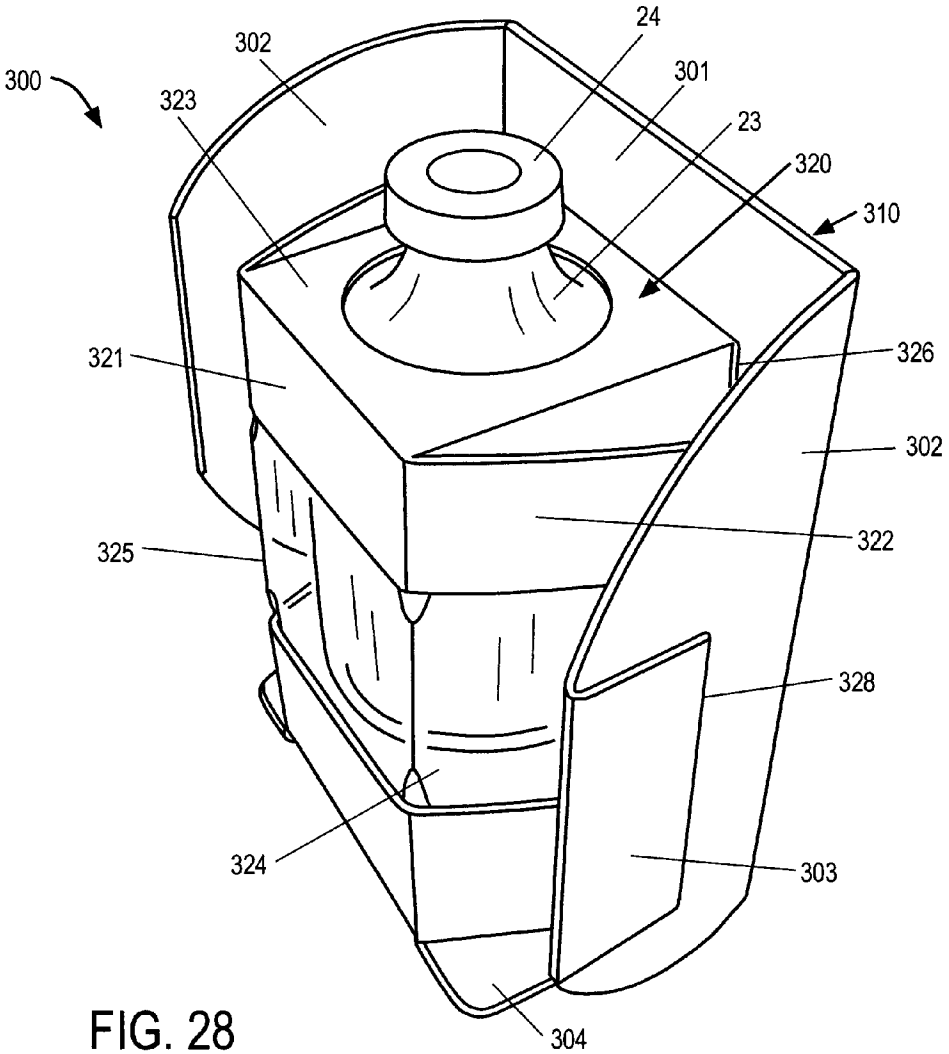
Figure 29:
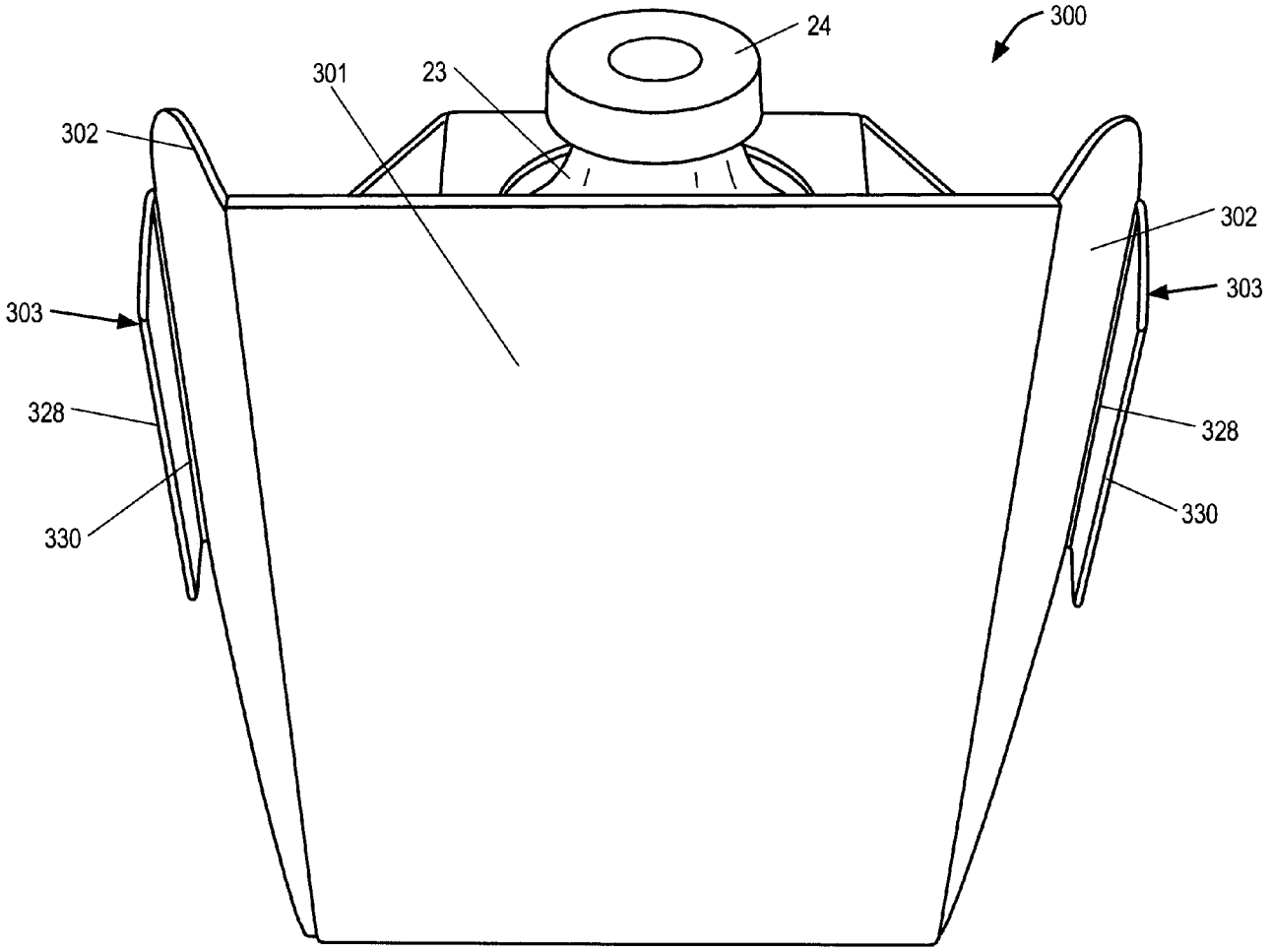
FIGS. 29-32 respectively are top/rear perspective, rear, front, and top views of an inner portion of an alternative package having a vial disposed therein, according to an embodiment of the present invention.
Figure 30:
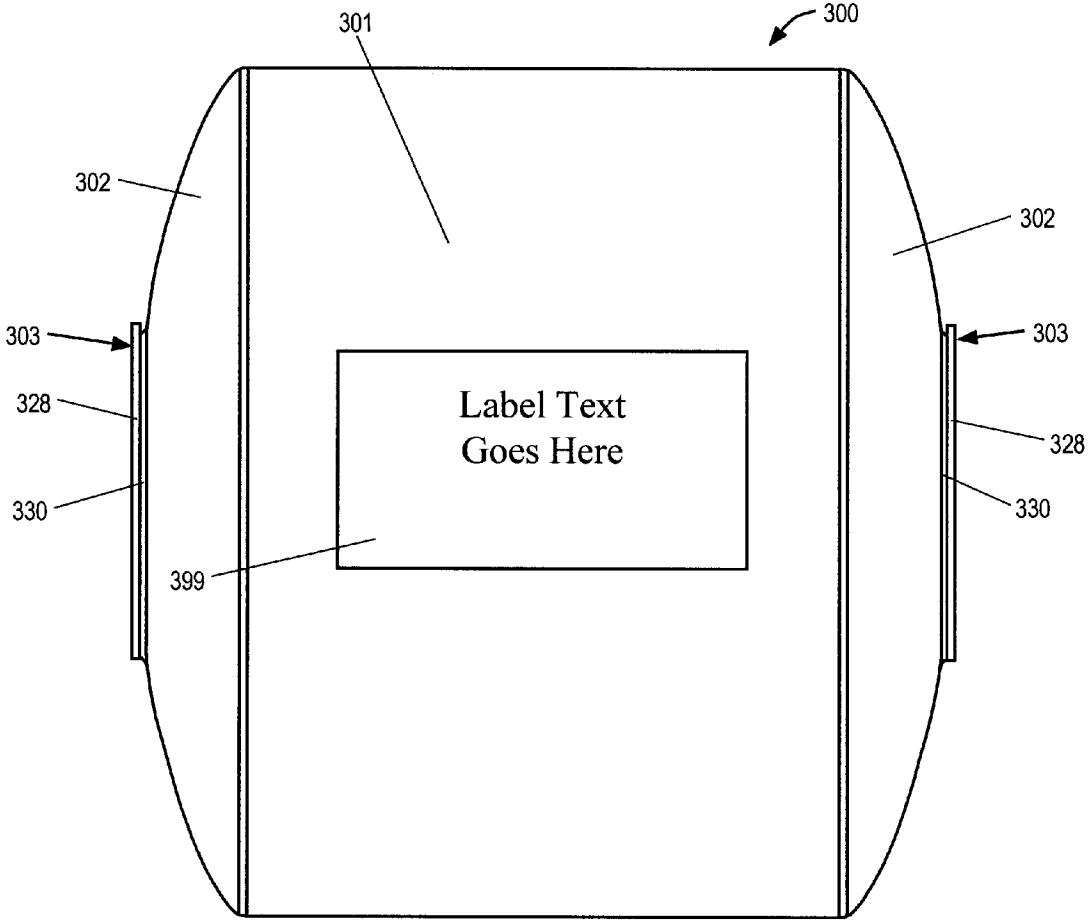
Figure 31:
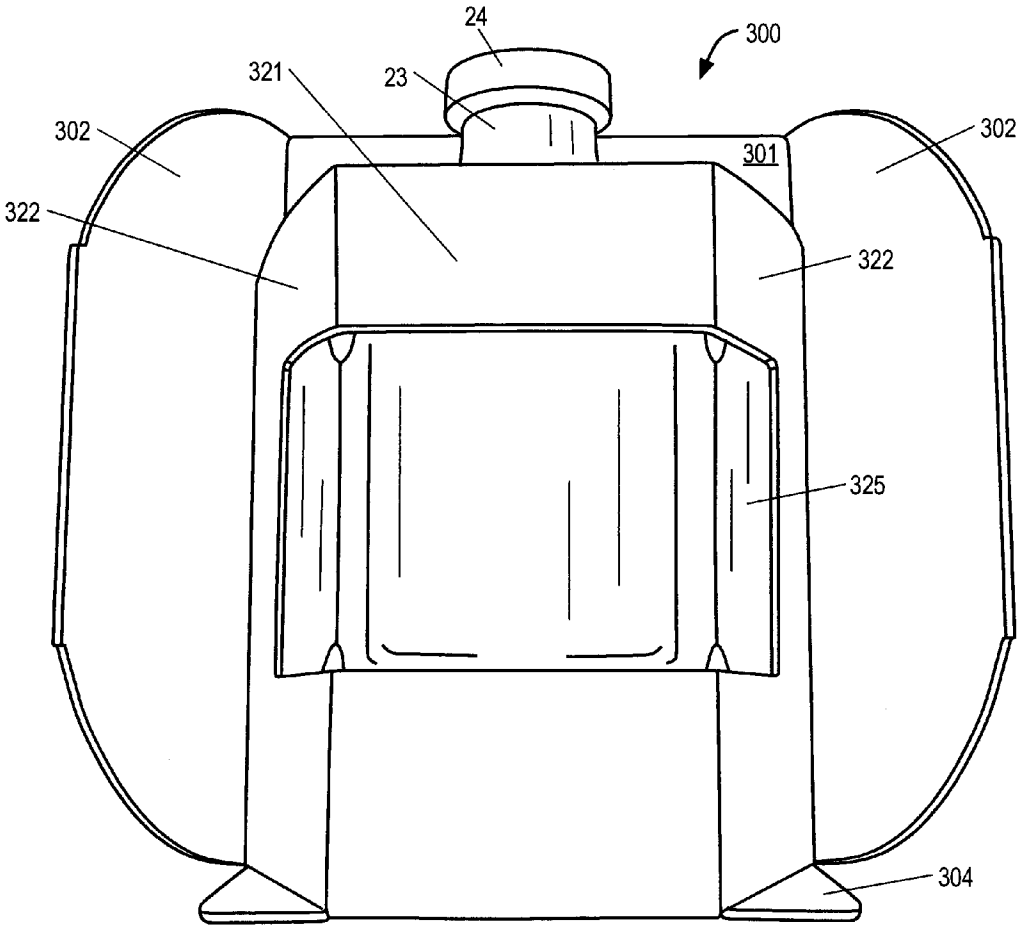
Figure 32:
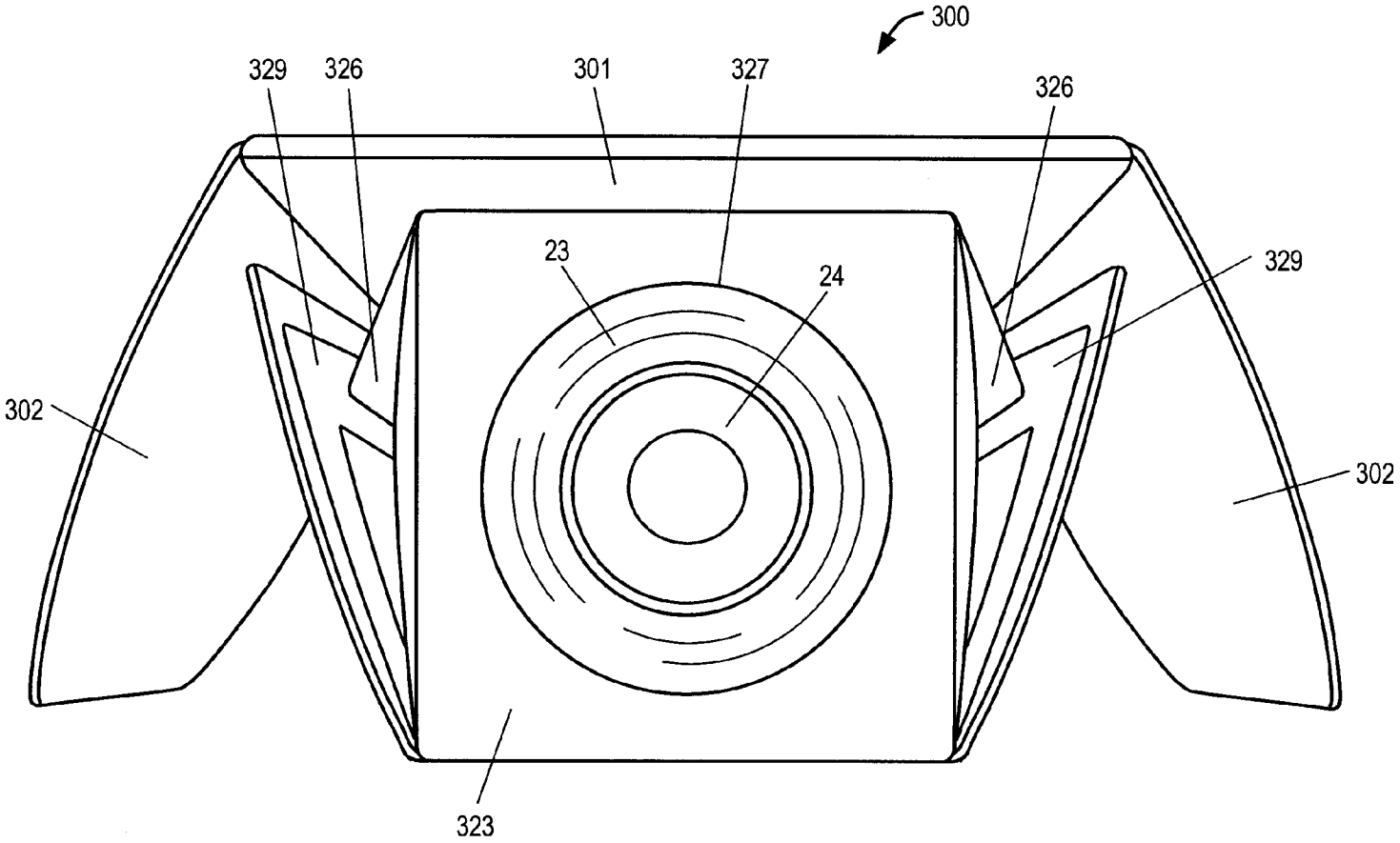

Embodiments of the present invention are directed to a carton (packaging) that may hold a vial within. An embodiment of the present invention allows a materials supply chain to label only a single level of packaging. Embodiments of the present invention are designed in a manner that will allow practitioners to prepare and administer the contents of the vial without removing the immediate container from the outer packaging. Another embodiment of the present invention includes a packaging that holds a vial (or similar), where the vial cannot be removed without intentionally destroying the internal components of the packaging (for example, the components shown in FIGS. 4 and 27).

Embodiments of the present invention allow for a clinical trial pooled supply for vial based/injectable compounds. Embodiments of the present invention also dramatically reduce packaging and labeling costs. Embodiments of the present invention can be used for clinical trials in countries/regions that must comply with Annex 13 requirements. Additionally, embodiments of the present invention are capable of being used in countries that have other requirements (in addition to, or in replace of, Annex 13 requirements).

Embodiments of the present invention include sealing individual vials into a primary container. In embodiments of the present invention, sealing vials into the container allows a materials supply chain to apply an Annex 13 compliant label only to the container.

Embodiments of the present invention are described throughout this application as being used to hold vials. Vials, as used throughout this application include any type of container, and are not limited to the traditional definition of vials. The contents of the vials included within the packages of embodiments of the present invention may be anything that a person skilled in the art would desire to be present in a container. The vials may also be empty. The vials that may be included within the packages of embodiments of the present invention may include caps and/or rubber stoppers or the like. The caps may include flip tops, twist tops, plug tops, or the like. The rubber stoppers, caps, or the like may be made of a material that is meant to be punctured by a needle for containing an injectable medicament or the like.

Moreover, embodiments of the present invention may be used to package other items instead of, or in addition to, vials.

As shown in the figures, in an embodiment of the present invention, when the package is opened, the protective flip-cap and rubber stopper are fully accessible for preparation, dosing, and administration of the contents.

An embodiment of the present invention includes a die cut top flap. It will be apparent to one skilled in the art that the top flap may include an aperture that is made through other methods other than die cutting as well. The die cut top flap ensures the vial cannot be removed after the top is folded over the top of the vial (e.g., the neck of the vial).

Embodiments of the present invention may also include tape panels. In an embodiment of the present invention, the tape panels include an aggressive tamper evident tape/adhesive that acts to effectively seal the primary container in a closed position. In an embodiment of the present invention, the only way to remove the vial is to destroy the package.

Preferably, when an embodiment of the present invention is assembled, the carton has only one side which needs to be sealed, which may be the top side of the carton (unlike most prior art cartons, which are sealed both at the top and on the bottom).

As described in greater detail below with reference to the figures, multiple apertures are included in certain embodiments of the present invention. The apertures are present to facilitate preparation for dosing by allowing a viewing window for the practitioner to inspect the contents of the vial before dosing. The apertures may have additional purposes as well, which would be apparent to a person of ordinary skill.

Embodiments of the present invention may include an outer cover that provides protection from light and any other elements during storage and shipment.

An embodiment of the present invention includes a carton that has been developed for the purpose of reducing the labeling required for parenteral dosage forms.

As used throughout this application, the package of embodiments of the present invention may be similar to a carton. That is, embodiments of the present invention may be constructed out of similar materials that are used for constructing the cartons of the prior art. Therefore, carton and package may be used synonymously throughout this application when referring to embodiments of the present invention. However, the packages of embodiments of the present invention may also be constructed out of different materials, including, but not limited to, paper or wood products, plastic, metal, glass, fiberboard, composite materials, and the like. One skilled in the art will understand that different materials, other than the materials described herein, may be utilized to construct the packages of embodiments of the present invention, and embodiments of the present invention are not limited to the materials described herein or shown in the figures.

Figure 1A:
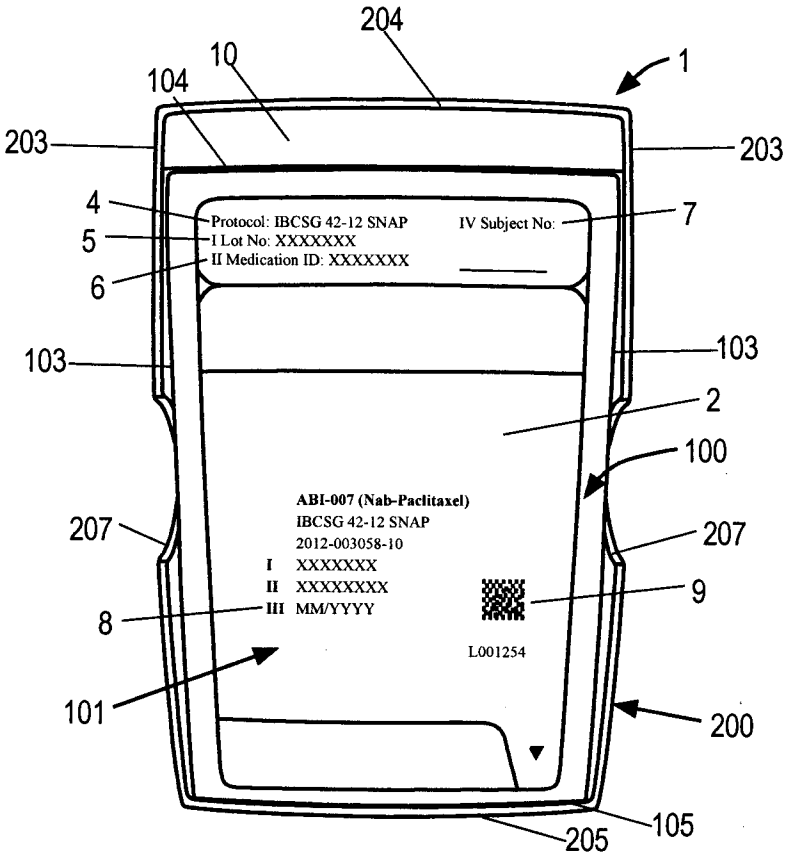

FIG. 1A is a front view of a package 1 constructed according to an illustrative embodiment of the present invention, which includes a pack-out design for injectable, vial based compounds. The package 1 shown in FIG. 1A includes an inner portion 100 having a vial disposed therein (vial not visible in FIG. 1A), and an outer portion 200. As shown in FIG. 1A, the inner portion 100 may be fully inserted within the outer portion 200; as described in greater detail below with reference to FIG. 10, the inner portion may be fully or partially disengaged from the outer portion 200, which may occur through a sliding motion or the like. Embodiments of the present invention also include packages in which the inner portion 100 and the outer portion 200 are engaged through means other than a sliding motion, for example, including, but not limited to, the outer portion 200 wrapping around the inner portion 100. The outer portion 200 includes a back portion 202 (not visible in FIG. 1A), side portions 203 optionally having cutouts 207 defined therein, a top portion 204, and a bottom portion 205. The inner portion 100 includes a front portion 101, a back portion 102 (not visible in FIG. 1A), a top portion 104, a bottom portion 105, and side portions 103. As described in greater detail below with reference to FIGS. 8 and 9, and optional cap protector may be arranged over the top of a vial disposed within the inner portion 100 (vial not visible in FIG. 1A). In the illustrated embodiment, the outer portion 200 acts as an outer sleeve for the inner portion 100 and optional cap protector 10 to be received within.

As shown in FIG. 1A, a label 2 may be affixed to the front portion 101 of the inner portion 100 of the package 1, preferably which is viewable regardless of the relative arrangement spatial arrangement of inner portion 100 and outer portion 200, e.g., may be seen even before the inner portion 100 is removed (separated/slid out) from the outer portion 200. The label 2 may include any information that a person skilled in the art would contemplate being present on a label. For example, the label may include identifying marks such as Protocol identification 4, lot identification 5, medication identification 6, subject identification 7, dates 8, barcodes 9 (e.g., QR codes), warnings, designs, symbols, pictures, or anything that one skilled in the art may desire to be present on such a package 1. The label 2 may be flat or planar, as illustrated in FIG. 1A, or alternatively may be a booklet label, which may include one or more leaflets that include study information and/or regulatory information. Preferably, the booklet label may be prominently visible and accessible at all times during shipment and storage. For example, FIG. 1B depicts a generic booklet label 2*a* affixed to the front portion 101 of the inner portion 100 of the package 1, which is viewable regardless of the relative spatial arrangement of inner portion 100 and outer portion 200, e.g., may be seen even before the inner portion 100 is removed (separated/slid out) from the outer portion 200. A flat label such as label 2 illustrated in FIG. 1A may be applied to a generic booklet label 2*a* such as illustrated in FIG. 1B. Alternatively, the booklet label or the information therein may be affixed within inner portion 100 (primary container), e.g., may be affixed to the back side of front portion 101 of the inner portion 100, so that the label or information may be seen only when the inner portion 100 is partially or fully removed from the outer portion 200.

One skilled in the art would readily understand that the package 1 may be any color or variety of colors, and the label 2 may be any color or variety of colors. Further, an embodiment of the present invention may not include a label on the front portion 101 of the inner portion 100.

As shown in the embodiment illustrated in FIG. 1A, the side portions 203 of the outer portion 200 may include cutouts 207 to ease in removing the inner portion 100 from the outer portion. Additionally, as shown in FIG. 1A, the package 1 further may include a cap protector 10, which is a thick protective portion disposed between the top portion 104 of the inner portion 100 and the top portion 204 of the outer portion.

Figure 2:
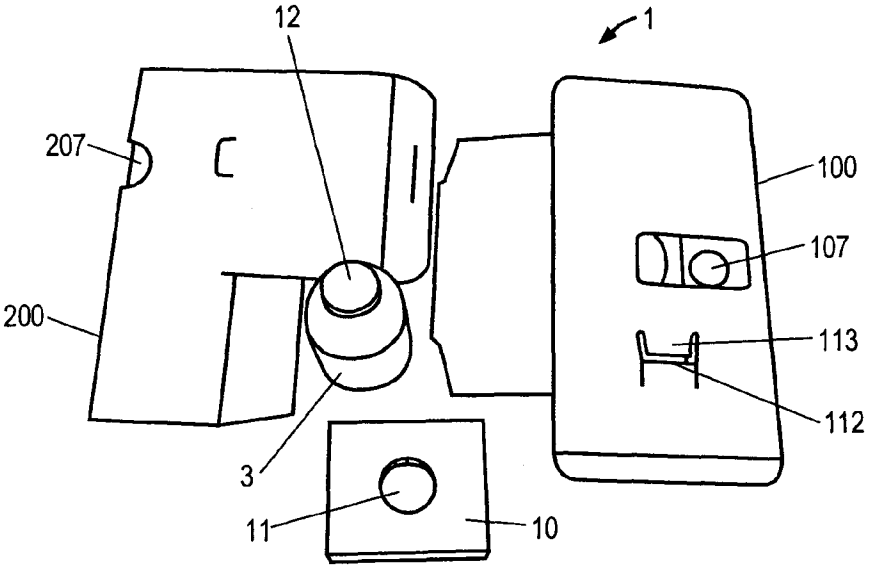
FIG. 2 is a perspective view of a vial and a package in an unassembled state, according to an embodiment of the present invention.

FIG. 2 is a perspective view of a vial 3 and of the components of the package 1 in an unassembled state, according to an embodiment of the present invention. As depicted in FIG. 2, the package 1 may include many apertures that may serve a variety of distinctive functions. For example, in an embodiment of the present invention, the cap protector 10 may include a thickness that accommodates an indented portion 11. The indented portion 11 may be sized to fit a vial top 12 within in order to protect said vial top 12. In an embodiment, package 1 is designed so that it can be shipped to a vendor or distributor as three flat components (the inner portion 100, the outer portion 200, and the cap protector 10), which may then be assembled to form the package 1 such as illustrated in FIG. 1A. Preferably, such components also may include specific training and support materials so that a packaging vendor or distributor can utilize the three flat components and form the package 1.

Figure 3:
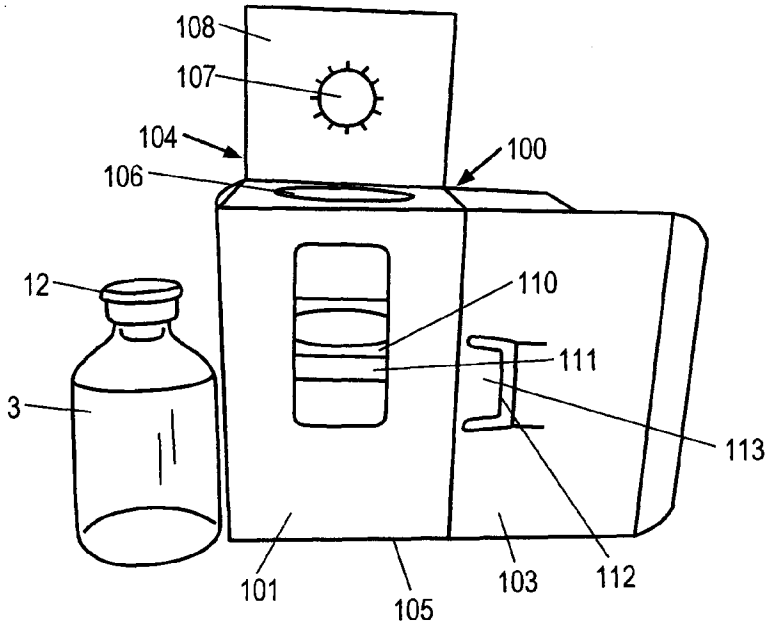
FIG. 3 is a perspective view of a vial and an inner portion of a package in a partially assembled state, according to an embodiment of the present invention.

FIG. 3 depicts the inner portion 100 of the package 1 in a semi-assembled state. After the inner portion 100 (which may also be referred to in the art as the primary container) is partially assembled, the vial 3 is placed into the inner portion 100 through the top portion 104. More specifically, in the embodiment shown in FIG. 3, the top portion 104 of the inner portion 100 includes a large top aperture 106 and a top flap 108 with a small top aperture 107. The large top aperture 106 is sized such that the vial 3 can be inserted into the inner portion 100 through the large top aperture 106. The top flap 108 then may be lowered over the vial and sealed into place, e.g., using glue, a tape-panel, pressure-sensitive adhesive, or the like, as described in greater detail below with reference to FIG. 6. The small top aperture 107 is sized such that the vial top 12 protrudes through the small top aperture 107 when the top flap 108 is lowered over the vial; optionally, cap protector 10 then may be disposed over vial top 12 such that indented portion 11 engages with vial top 12, such that vial 3 can thus optionally be further protected by the cap protector 10, in addition to protection provided by inner portion 100.

Figure 5:
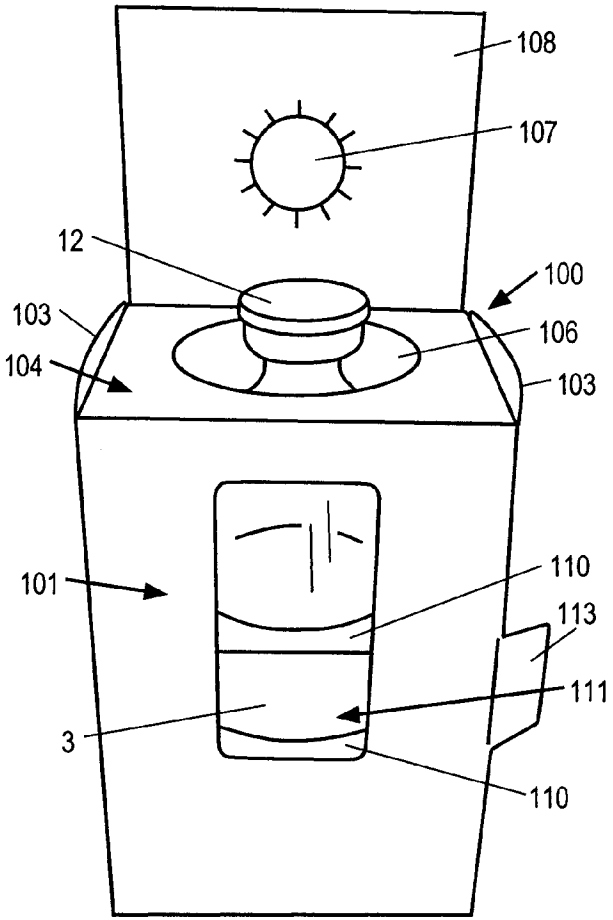
FIGS. 4 and 5 respectively are side and front views of an inner portion of a package in a partially assembled state and having a vial disposed therein, according to an embodiment of the present invention.
Figure 4:
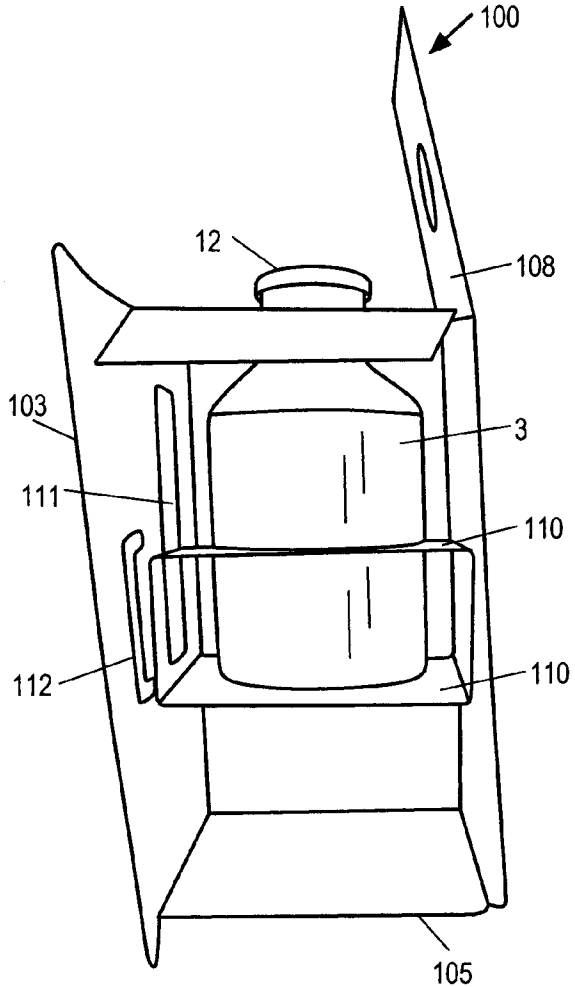

For example, as further shown in FIGS. 3, 4, and 5, in which the inner portion 100 is partially assembled and is disengaged from outer portion 200, the inside of the inner portion 100 may include vial supports 110 to help stabilize the vial when it is disposed inside the inner portion 100. The outside of the inner portion 100 may also include additional apertures. For example, the outside of the inner portion 100 may include a vial label viewing aperture 111 and a side tab aperture 112. The outside of the inner portion 100 in an embodiment of the present invention may also include a side tab 113. Side tab aperture 112 and side tab 113 may be used to lock inner portion 100 to outer portion 200.

Figure 7:
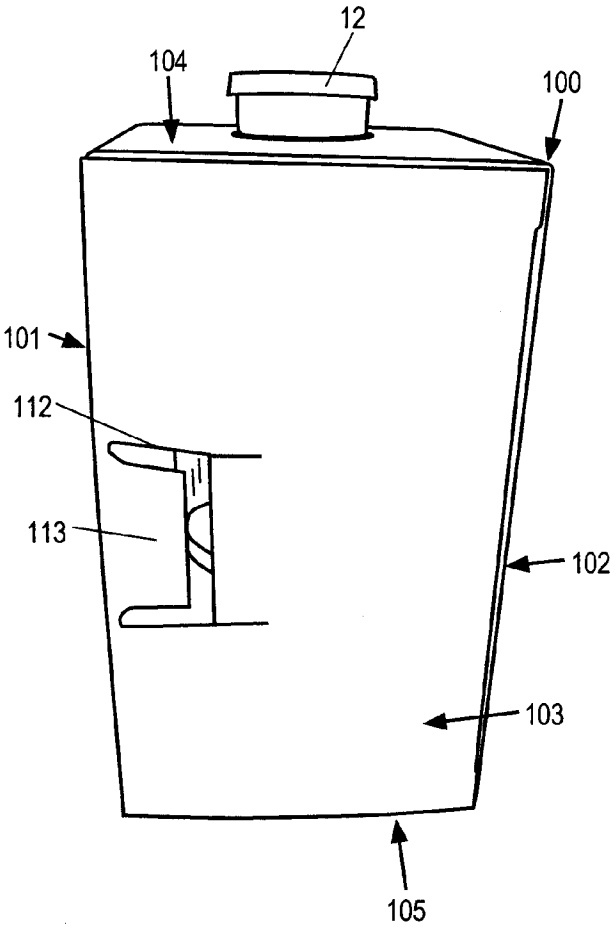
FIGS. 6 and 7 respectively are front and side views of an inner portion of a package fully assembled and closed and having a vial disposed therein, according to an embodiment of the present invention.
Figure 6:
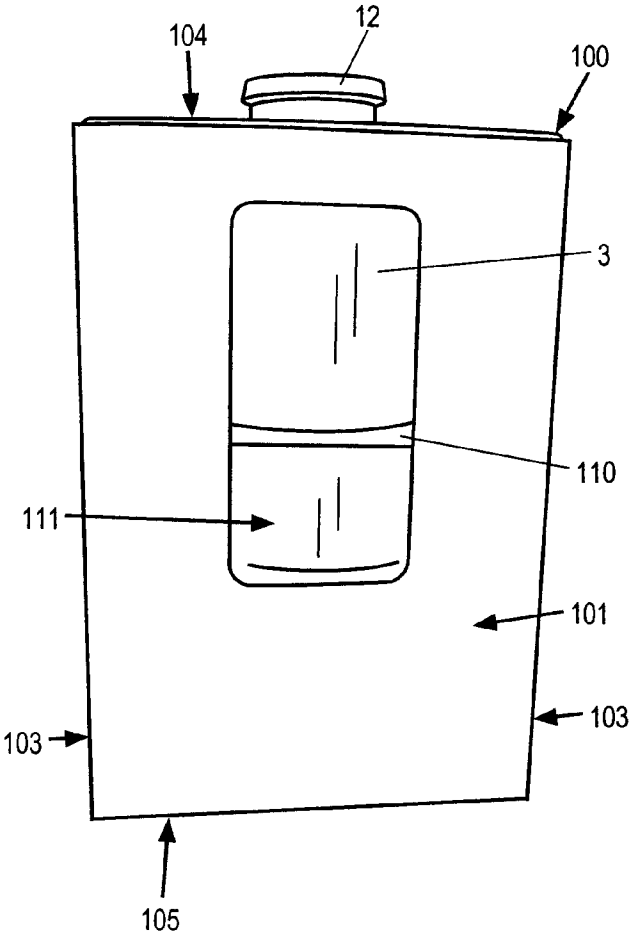

FIGS. 6 and 7 show the inner portion 100 of the package 1 fully assembled and closed. In the illustrated embodiment, the top flap 108 overhangs approximately 0.25 inches, and folds over a portion of the inner portion 100 (primary container), which may be the front portion 101, back portion 102, or side portion 103. When an inner portion 100 of an embodiment of the present invention is assembled, the top flap 108 may be secured by glue, a tape-panel, a pressure sensitive adhesive strip that may be exposed when the liner is removed by a packager, or other suitable method of securement.

In embodiments of the present invention, one skilled in the art will readily understand that more or less apertures may be added to the inner and outer portions, and the number of apertures present is not limited to the number shown in the figures. For example, there may be additional apertures relative to those shown in FIG. 6. These additional apertures may increase the amount of incoming light in order to facilitate preparation of the compound for further preparation and administration.

Figure 9:
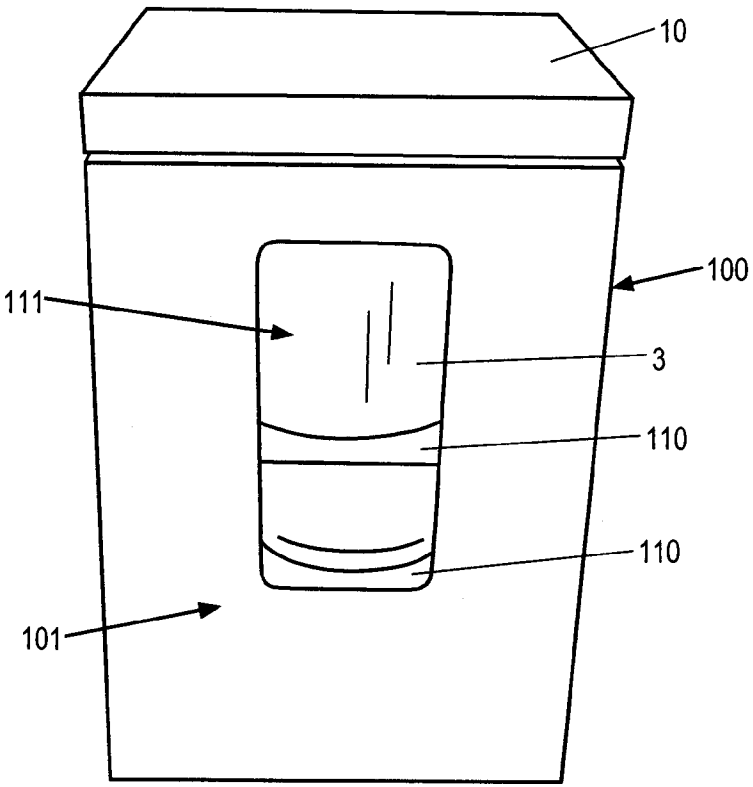
FIG. 9 is a perspective view of a cap protector engaged with a top portion of an inner portion of a package having a vial disposed therein, according to an embodiment of the present invention.
Figure 8:
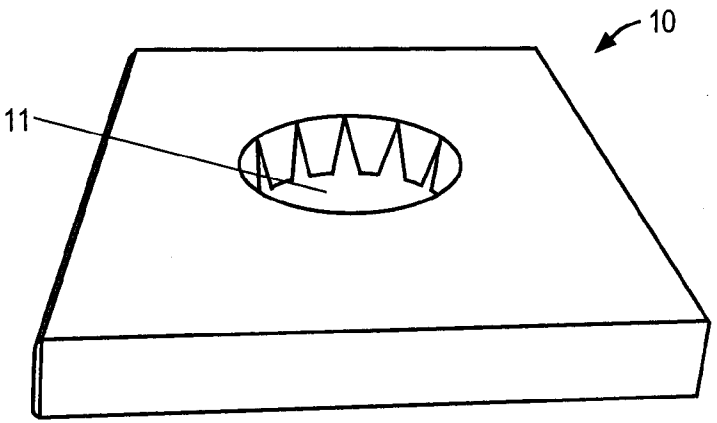
FIG. 8 is a perspective view of a cap protector for use with an inner portion of a package having a vial disposed therein, according to an embodiment of the present invention.

FIG. 8 depicts the cap protector 10, which may serve as a protector for vial top 12 as well as the top flap 108. In an embodiment of the present invention, the cap protector 10 may be utilized as a spacer to ensure a snug fit of the inner portion 100 within the outer portion 200. The cap protector 10 protects the vial top 12, which may include a vial flip-cap. FIG. 9 shows the cap protector 10 engaged with the top portion 104 of the inner portion 100 of the package 1 in an embodiment of the present invention.

Figure 10:
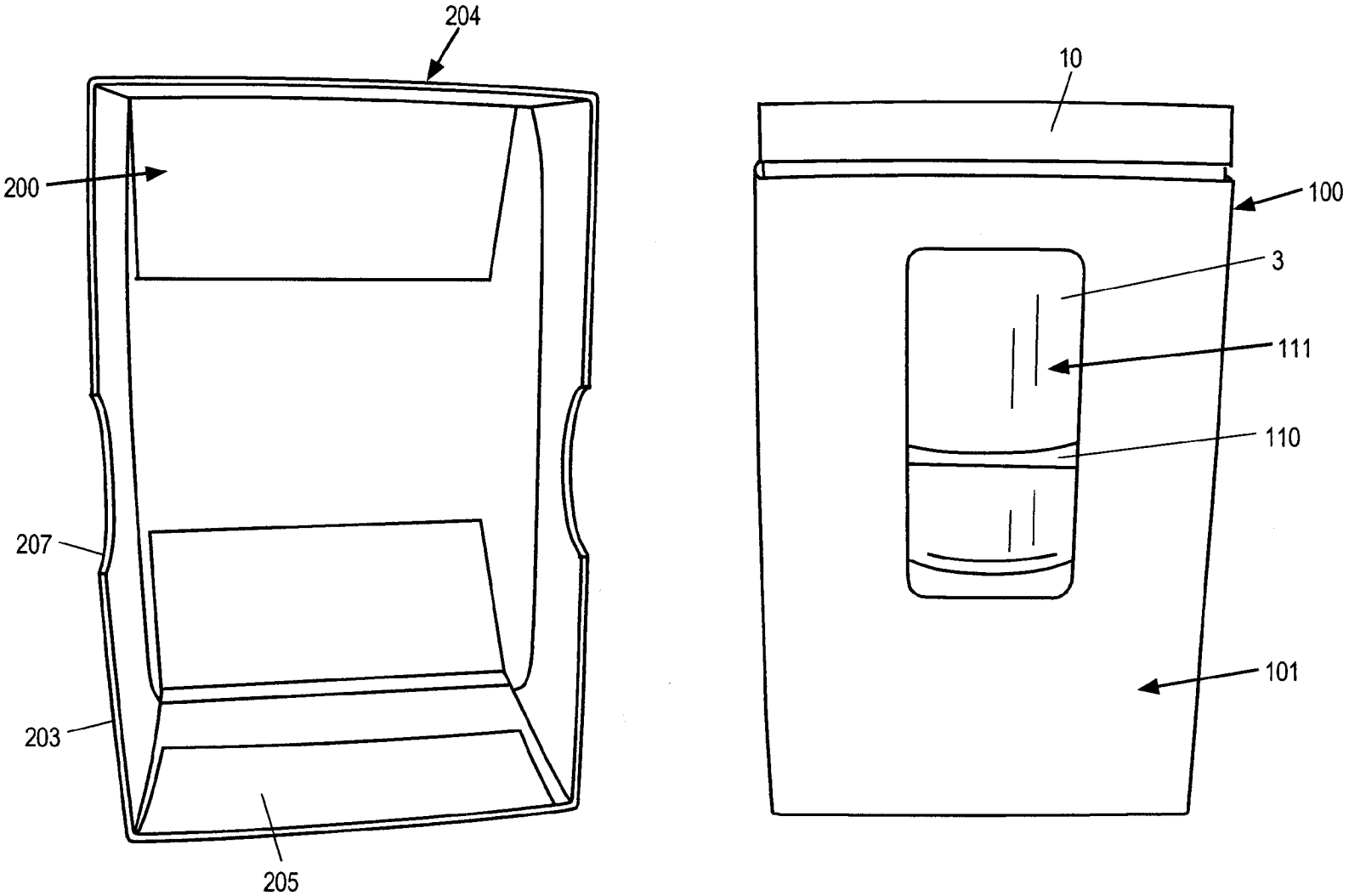
FIG. 10 is a front view of an inner portion and an outer portion of a package positioned near one another before the inner portion is slid into the outer portion, according to an embodiment of the present invention.
Figure 11:
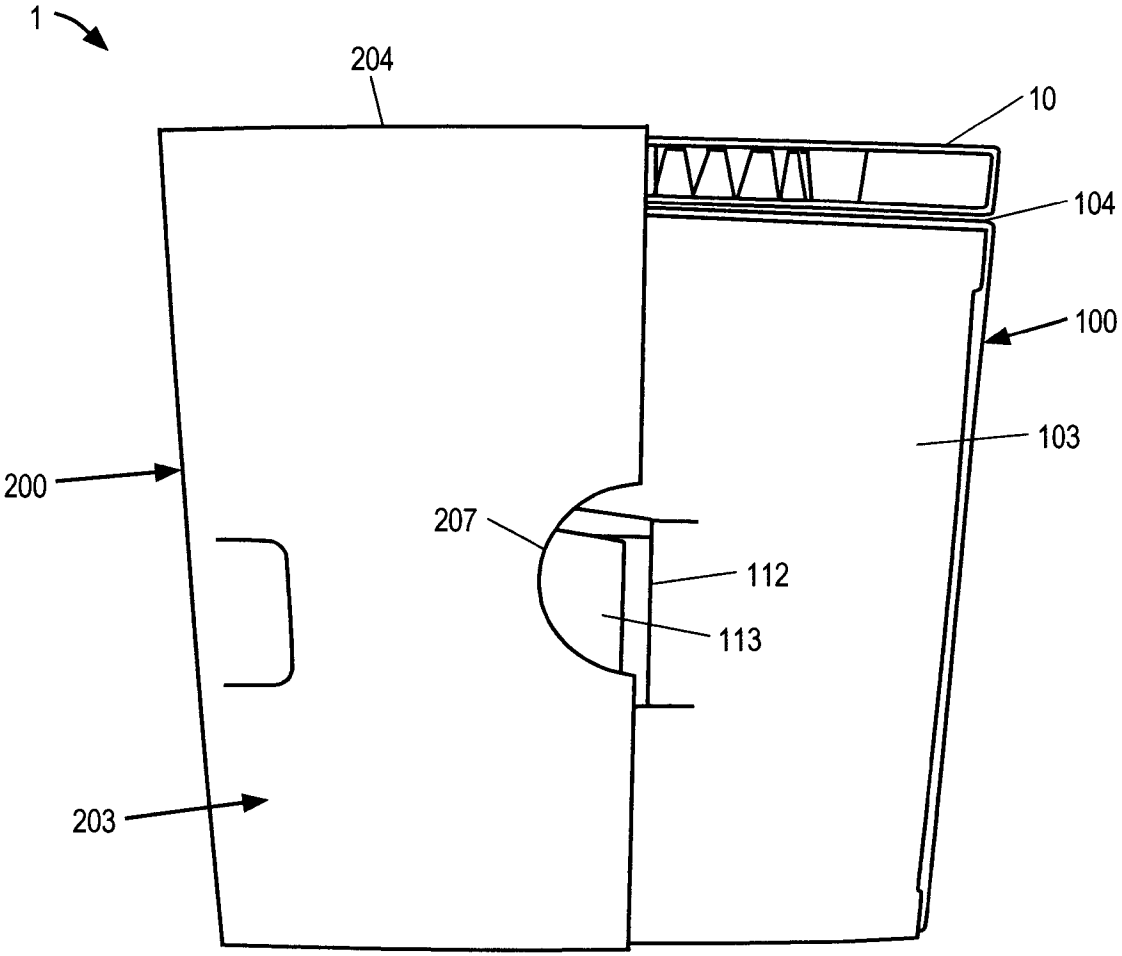
FIG. 11 is a side view of an inner portion partially slid into an outer portion of a package, according to an embodiment of the present invention.

As shown in FIGS. 10 and 11, in an embodiment of the present invention, the inner portion 100 (primary container) slides into the outer portion 200 (outer sleeve). An embodiment of the present invention may include a locking feature on the outer portion 200 to prevent the inner portion 100 from inadvertently falling out. In another embodiment of the present invention, the locking feature is located on the inner portion 100 of the package 1. The locking feature may include, but is not limited to, an adhesive, a flap, a latch, a notch, a punch, or the like. In some embodiments, the inner and outer portions include features that lock to one another so as to inhibit full removal of the inner portion 100 from the outer portion 200 after the inner portion 100 is inserted into the outer portion 200.

Figure 13:
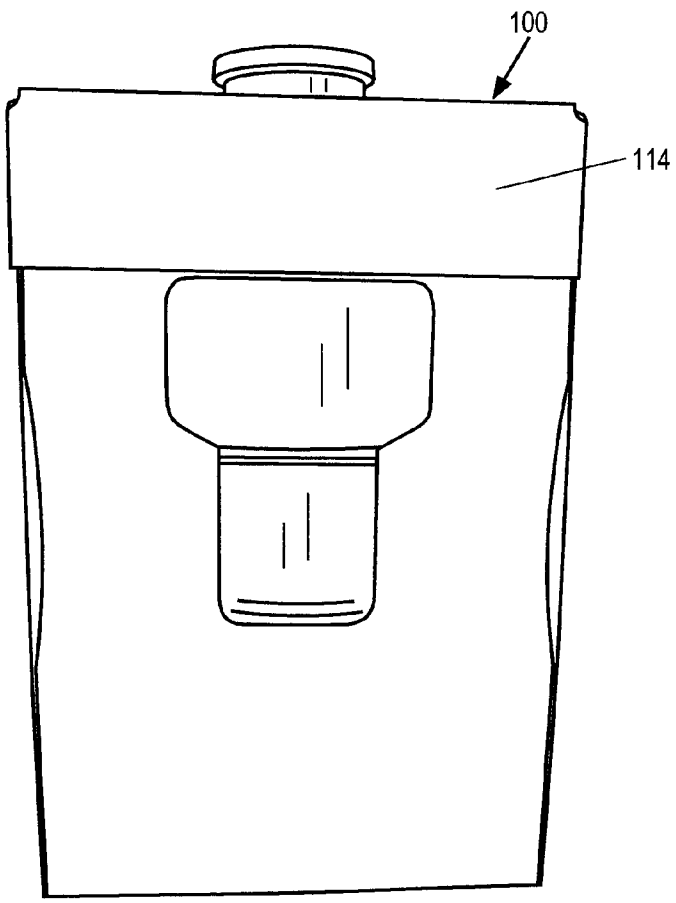
FIGS. 12-14 respectively are side/rear, rear, and rear/side perspective views of an inner portion of a package having a vial disposed therein and including a tape-panel, according to an embodiment of the present invention.
Figure 12:
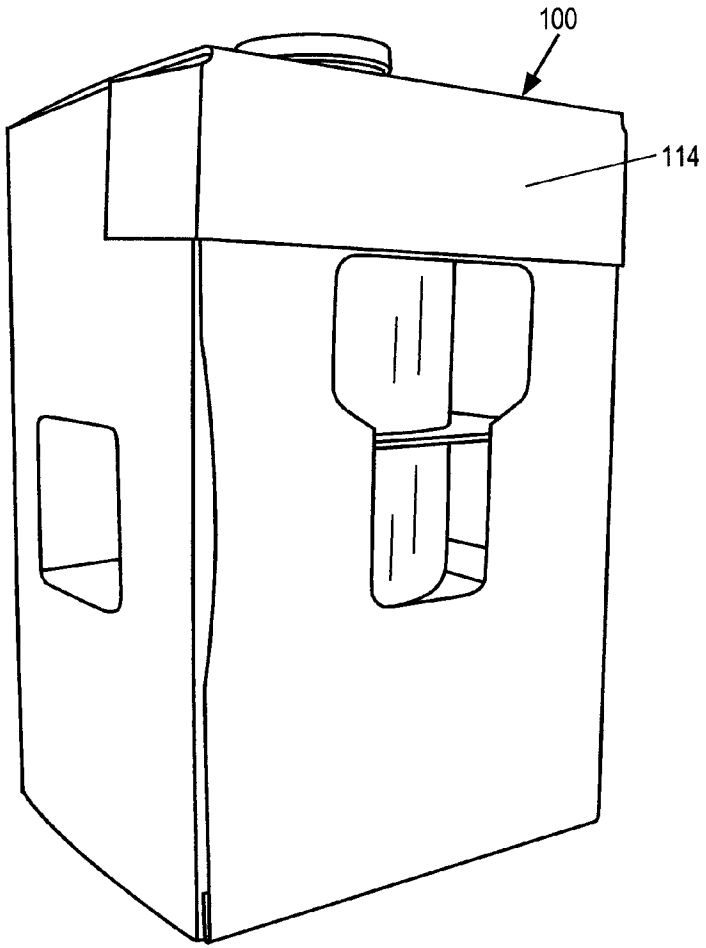
Figure 14:
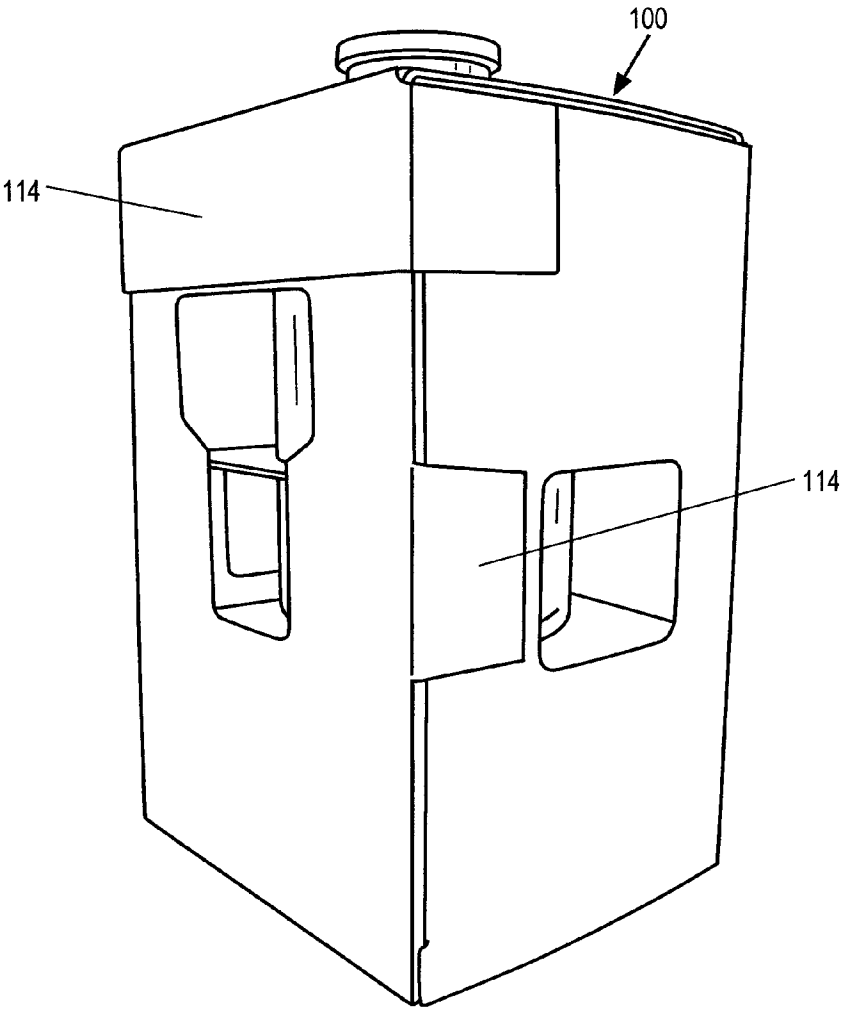
Figure 16:
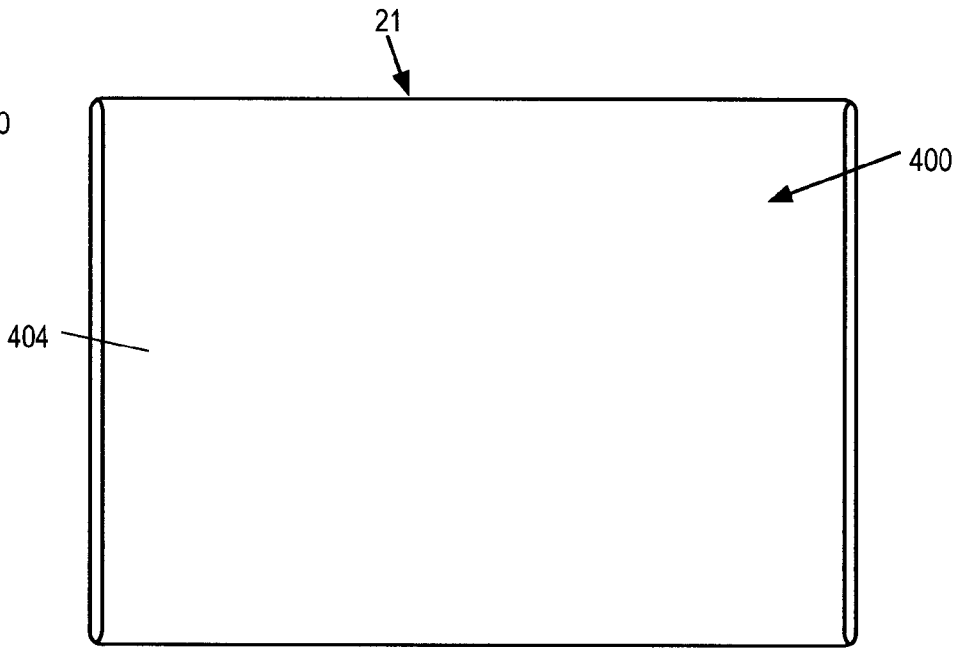
Figure 15:
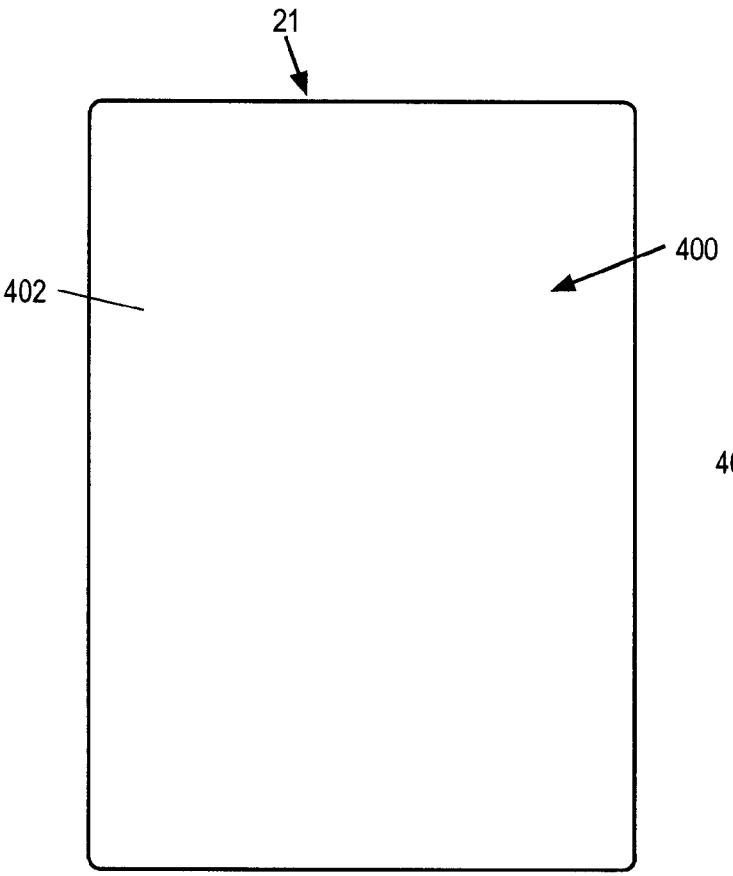

FIGS. 12-14 depict an inner portion 100 that include additional security features, according to an embodiment of the present invention. Specifically, in the exemplary embodiment shown in FIGS. 12-14, an inner portion 100 of an embodiment of the present invention that includes tape panels 114. The tape panels 114 may include an aggressive tamper evident tape/adhesive that acts to effectively seal the inner portion 100 in a closed position, as shown in FIG. 12-14. In an embodiment of the present invention, the only way to remove the vial is to destroy the inner portion 100.

One of the potential uses of embodiments of the present invention may be for drug companies' products that are contained in vials for commercial use, or for use in global clinical studies including, but not limited to, pooled supplies. Embodiments of the present invention allow a materials supply chain or similar to have supplies permanently sealed into a secondary package so that companies do not have to label both levels of packaging (i.e., vials and cartons and/or both primary and secondary packages) with trial- and country-specific labeling. In doing so, embodiments of the present invention will reduce the cost of packaging and labeling. Embodiments of the present invention also may facilitate the packaging of pooled supplies by ensuring that all labeling is easily accessible for labeling at the point of distribution while maintaining global regulatory compliance, including, but not limited to, Annex 13 compliance (for investigational medicinal products). Additionally, embodiments of the present invention may ensure that there is empty space surrounding the vial, which can reduce the risk of breakage without requiring a separate cell divider, foam liner, or the like.

The use of embodiments of the present invention in pooled supplies, e.g., for use in clinical trials or for commercial use, will now be discussed.

Embodiments of the present invention may be packaged and labeled at a vendor, e.g., a packaging or distribution vendor, with appropriate labeling with the exception of study specific Annex 13 information, which prohibits pooling by making the labeling protocol specific (Protocol/Study Number, European Union Drug Regulating Authorities Clinical Trials Number and sponsor information). The generically labeled kits that may be included in the packaging of embodiments of the present invention may be kept in inventory as pooled supplies until they are requested for a specific study. When a shipping request is raised, a Just In Time (JIT) label may be printed at the point of distribution, and may include the Annex 13 information. This label may be applied to embodiments of the present invention just before shipping to a clinical trial site. Using embodiments of the present invention, a packaging or distribution vendor will only need to apply one label. Traditional packaging of the prior art would require that a packaging or distribution vendor generates two labels, open each kit, apply a label to the immediate container (vial), repack the vial in the carton, seal the carton, and apply a label to the carton.

The use of embodiments of the present invention in non-pooled supplies, e.g., for use in clinical trials or for commercial use, will now be discussed.

In non-pooled supplies, vials may be sealed into the packaging of embodiments of the present invention and a single label may be applied to a portion of the package Embodiments of the present invention will allow a materials supply chain to have supplies permanently sealed into a secondary package so that they do not have to label both levels of packaging (vials and cartons). Thus, embodiments of the present invention will reduce the cost of packaging and labeling. Traditional packaging would require that the vendor apply a label to the immediate container (vial), place a liner in the carton (if needed), pack the vial in the carton, seal the carton, and apply a label to the carton.

In an embodiment of the present invention, the finished goods may be stored at the point of distribution labeled with a generic booklet label (without any protocol/study specific information in the case of a clinical trial, or without any patient-specific information in the case of a commercial product). The Protocol Number and European Union Drug Regulating Authorities Clinical Trials Number, or any other patient-specific information, may be printed on an ancillary label which may be affixed to the booklet cover at the point of distribution just before shipment to the clinical or commercial site.

An alternate embodiment of the present invention is shown in FIGS. 15-41.

As shown in the figures, in an embodiment of the present invention, when the package is opened, the top of the vial is fully accessible for preparation, dosing, and administration of the contents.

When an embodiment of the present invention is assembled, the inner portion is held within the outer portion to form a carton. The carton can release the inner portion from the outer portion through a user squeezing side tabs and sliding the inner portion out from engagement with the outer portion.

As shown in the figures, multiple windows may be included in an embodiment of the present invention. The windows are present to facilitate preparation for dosing by allowing a viewing area for the practitioner to inspect the contents of the vial before dosing. The windows may have additional purposes as well, which would be apparent to a person of ordinary skill.

Figure 20B:
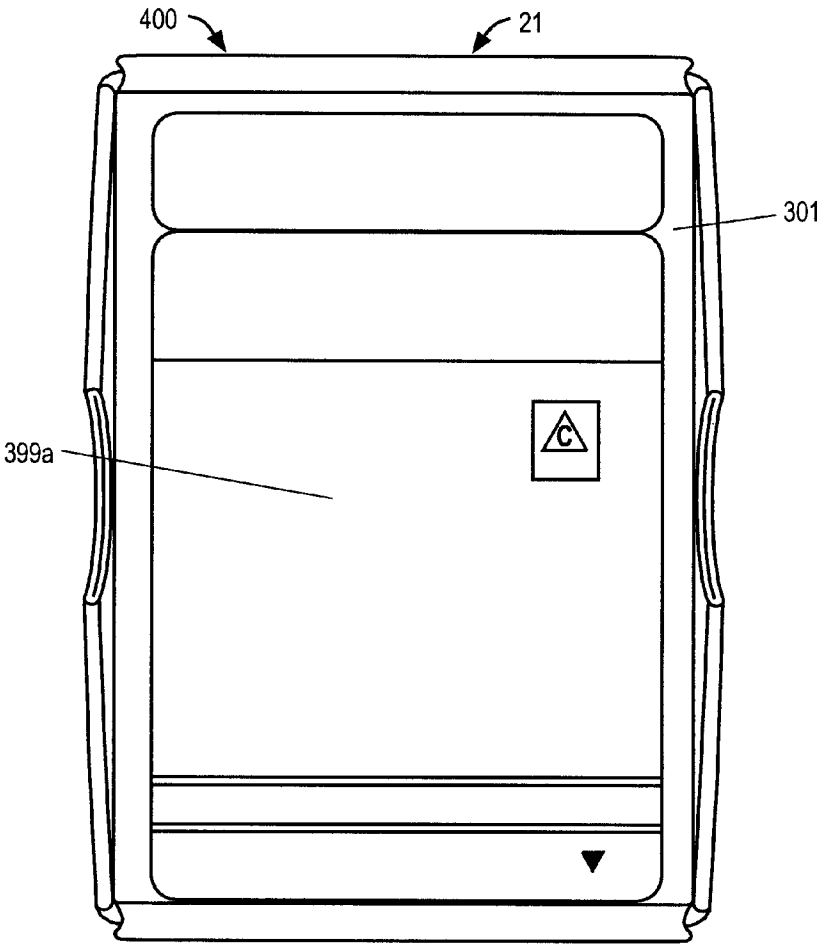
FIG. 20B is a rear view of an alternative package that includes a booklet label, according to an embodiment of the invention.
Figure 20A:
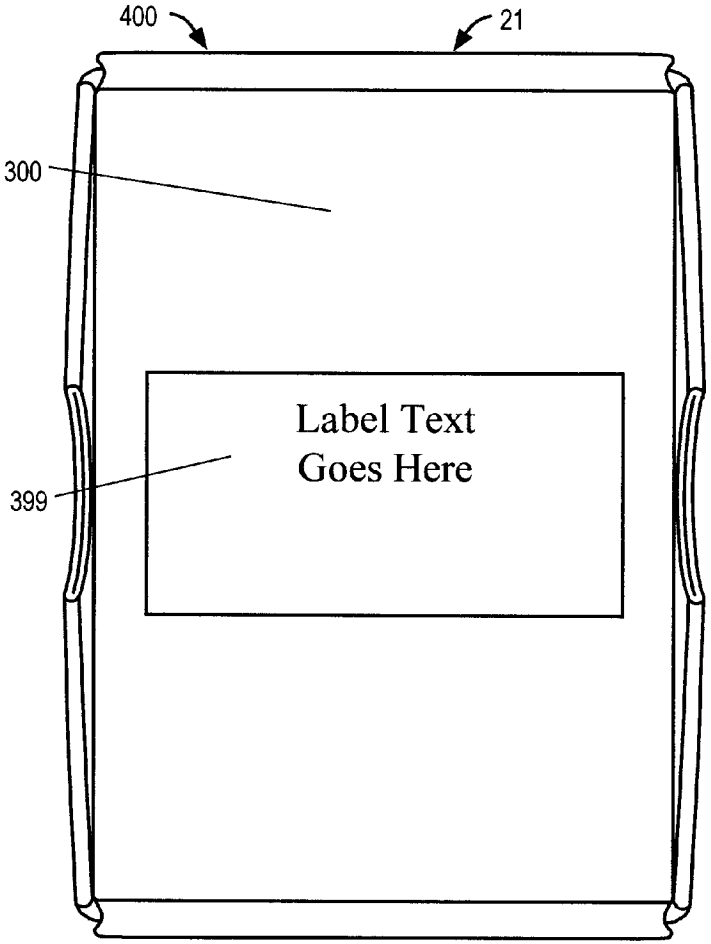

FIGS. 15-19 respectively illustrate the front, top, bottom, first side, and second side, views of a package design for injectable, vial based compounds according to a preferred embodiment of the present invention, and FIGS. 20A-20B respectively illustrate rear views of such a package design having either a flat label or a booklet label. The package 21 shown in FIGS. 15-20B includes an inner portion 300 and an outer portion 400, although only outer portion 400 is readily visible in FIGS. 15, 16, and 17. As shown in these figures and perhaps best seen in FIGS. 18, 19, and 20A, when the inner portion 300 is engaged with the outer portion 400 such that cavity 401 defined within outer portion 400 receives the inner portion, only the rear 301 and a small area of the cooperating portion sides 302 of the inner portion 300 are visible. The rear 301 of the inner portion 300 is visible because of the cavity 401 in the rear of the outer portion 400. The outer portion 400 includes a front surface 402, side surfaces 403, a top surface 404, and a bottom surface 405 that collectively define cavity 401. The cooperating portion sides 302 of the inner portion 300 are visible because of cutouts 408 included on the side surfaces 403 of the outer portion 400. The side surfaces 403 of the outer portion 400 also include substantially semicircular shaped slits 406, which create substantially semicircular flaps 407 that engage with the inner portion 300 as explained in more detail below. In an embodiment of the present invention, the outer portion 400 acts as an outer sleeve for the inner portion 300 to be received within.

Figure 17:
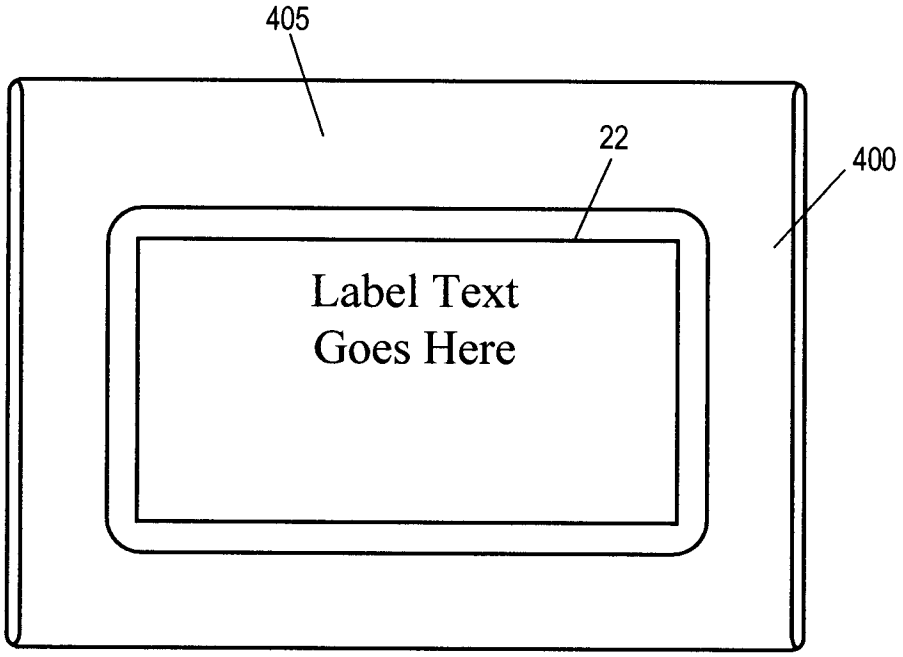
Figure 19:
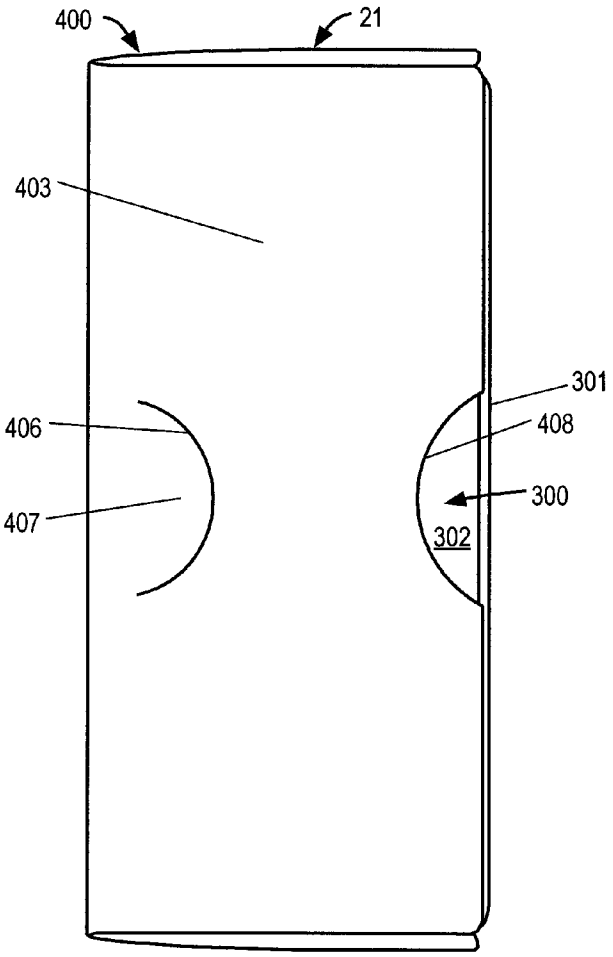
Figure 18:
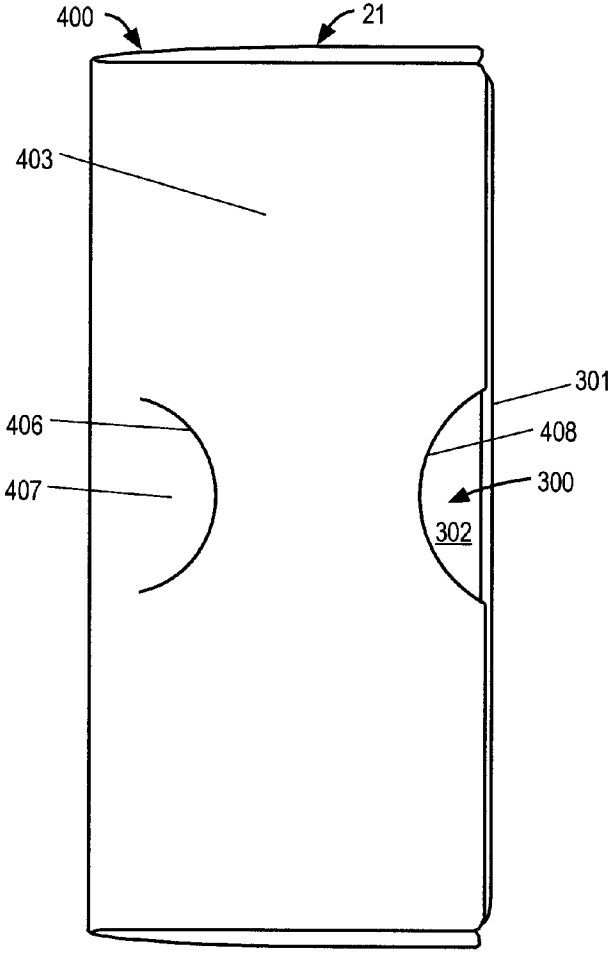
Figure 26:
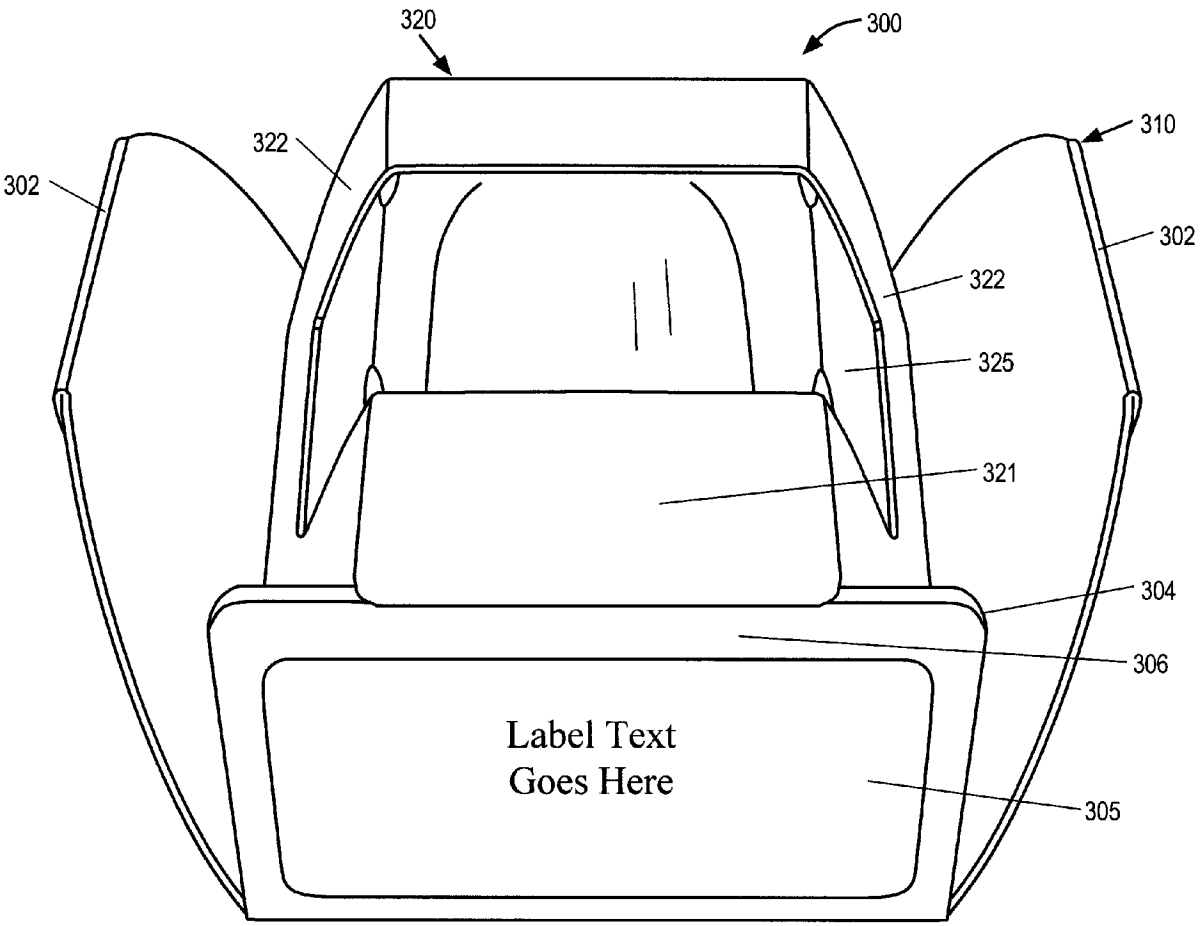

As shown in FIG. 17, the bottom surface 405 of the outer portion 400 includes a label 22 in a preferred embodiment of the present invention. The label 22 may include any information that a person skilled in the art would contemplate being present on a label. For example, the label may include identifying marks such as Protocol identification, lot identification, medication identification, subject identification, dates, barcodes, warnings, designs, symbols, pictures, manufacturer information, supplier information, physician information, or anything that one skilled in the art would desire to be present on such a package 21. The label 22 may be flat or planar, or alternatively may include a booklet label, which may comprise study information and/or regulatory information, such as described above with reference to FIG. 1A. Moreover, only ancillary label text may be included on the label 22 shown in FIG. 17, while the main label 399 or 399*a* of a preferred embodiment of the present invention is affixed to the inner portion 300, shown, for example, in FIG. 20A or 20B respectively (i.e., the rear 301 of the inner portion 300). In other words, in a preferred embodiment of the present invention the main clinical label is applied to the inner portion 300. Applying the label to the exterior face (the rear 301 of the inner portion 300) when the inner portion 300 is engaged to the outer portion 400 will allow the pharmacist to see the label when the supplies are on the shelf, e.g., as illustrated in FIG. 20A or 20B. Alternatively, if a main label such as illustrated in FIG. 17 is applied only to the bottom surface 306, the label may not be visible when the supplies are packaged on a shelf. FIG. 26 shows another label 305 disposed on the bottom surface 306 of the inner portion 300. This label 305 may include ancillary label text in an embodiment of the present invention.

One skilled in the art would readily understand that the package 21 may be any color or variety of colors, and the label 22 may be any color or variety of colors. Further, an embodiment of the present invention may not include a label.

As shown in FIGS. 21-38, the inner portion 300 in a preferred embodiment of the present invention holds a vial 23. In its assembled state, the inner portion 300 includes a vial holding portion 320 and a cooperating portion 310 designed to engage with the outer portion 400. The cooperating portion 310 includes the rear 301 and cooperating portion sides 302 of the inner portion 300. In other words, the cooperating portion 310 allows the inner portion 300 to engage with the outer portion 400 in an embodiment of the present invention. Specifically, in an embodiment of the present invention, the sides 302 are made from the same piece as the rear 301 and are folded inward to create a box shape that can be slid into the cavity 401 of the outer portion 400. In fact, in a preferred embodiment of the present invention, the entire inner portion 300 is a single component that can be folded and adhered to form the shape shown in the figures. The cooperating portion sides 302 include substantially rectangular flaps 303, perhaps best seen in FIG. 29, that are folded down and adhered to the rear portion of the cooperating portion sides 302 in order to cooperate with the substantially semicircular shaped slits 406 formed on the outer portion 400, perhaps best seen in FIGS. 22 and 23, when the inner portion 300 is slid into the cavity 401 of the outer portion 400. The substantially rectangular flaps 303 may be adhered to the cooperating portion sides 302 by glue, tape, or the like. In an embodiment of the present invention, the substantially rectangular flaps 303 are adhered to the cooperating portion sides 302 by a foam glue composite 330 that enables the flaps 303 to project slightly from the cooperating portion sides 302. FIG. 34-38 illustrate various views of the inner portion 300 in partially assembled states, so as to further illustrate relationships between the various components of the inner portion.

The base 304 of the cooperating portion 310 also acts as a base for the vial holding portion 320. The bottom surface 306 of the base 304 optionally includes a label 305 in an embodiment of the present invention, as perhaps best seen in FIG. 26. The label 305 may include the same information as the label 22 on the outer portion 400, or it may include different information.

The vial holding portion 320 is part of the single component that also makes up the cooperating portion 310 in an embodiment of the present invention. A portion extending from the base 304 is folded numerous times to form the shape of the vial holding portion 320 shown in the figures. Specifically, the vial holding portion 320 includes a front 321, sides 322, a top 323, and a vial support 324 that rests on the base 304. In an embodiment of the present invention, the vial holding portion 320 further includes a viewing window 325 that may be integrally coupled with the single component that creates the inner portion 300. The viewing window 325 may be constructed out of a clear or translucent material so that the contents of the vial 23 (or an optional label on the vial 23) are visible. The viewing window 325 may also simply be formed from cutouts in the front 321 and/or sides 322 of the vial holding portion 320. The sides 322 of the vial holding portion 320 may be secured onto extensions 326 of the rear, top, and/or bottom portion in order to form a substantially rectangular box shape, which may be accomplished through the use of an adhesive, tape, or the like. In an embodiment of the present invention, the top 323 of the vial holding portion 320 includes a top aperture 327 such that the vial top 24 protrudes therethrough. The extensions 326 may include, or may be replaced by, a receiving flap to secure closure of the vial holding portion sides 322 in an embodiment of the present invention.

In a preferred embodiment of the present invention, the vial top 24 is exposed from the vial holding portion 320 of the inner portion 300 such that a user may utilize the contents of the vial 23 while keeping the vial inside of the inner portion 300. In an embodiment of the present invention, removal of the vial 23 will cause the package 21, and more specifically the inner portion 300, to be destroyed. In this manner the package 21 is tamper evident. For example, vial holding portion 320 may include one or more tape-panels such as described above with reference to FIGS. 12-14.

Figure 33:
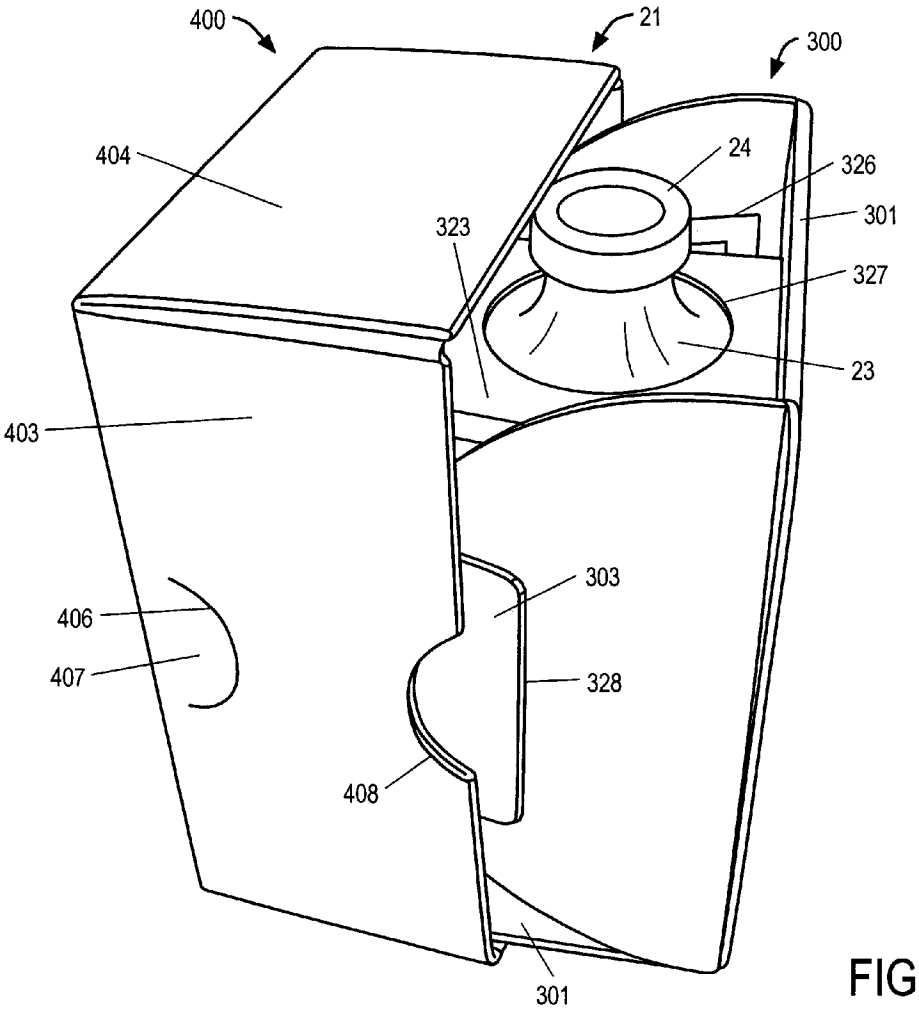
FIG. 33 is a perspective view of an inner portion partially slid into an outer portion of an alternative package, according to an embodiment of the present invention.
Figure 34:
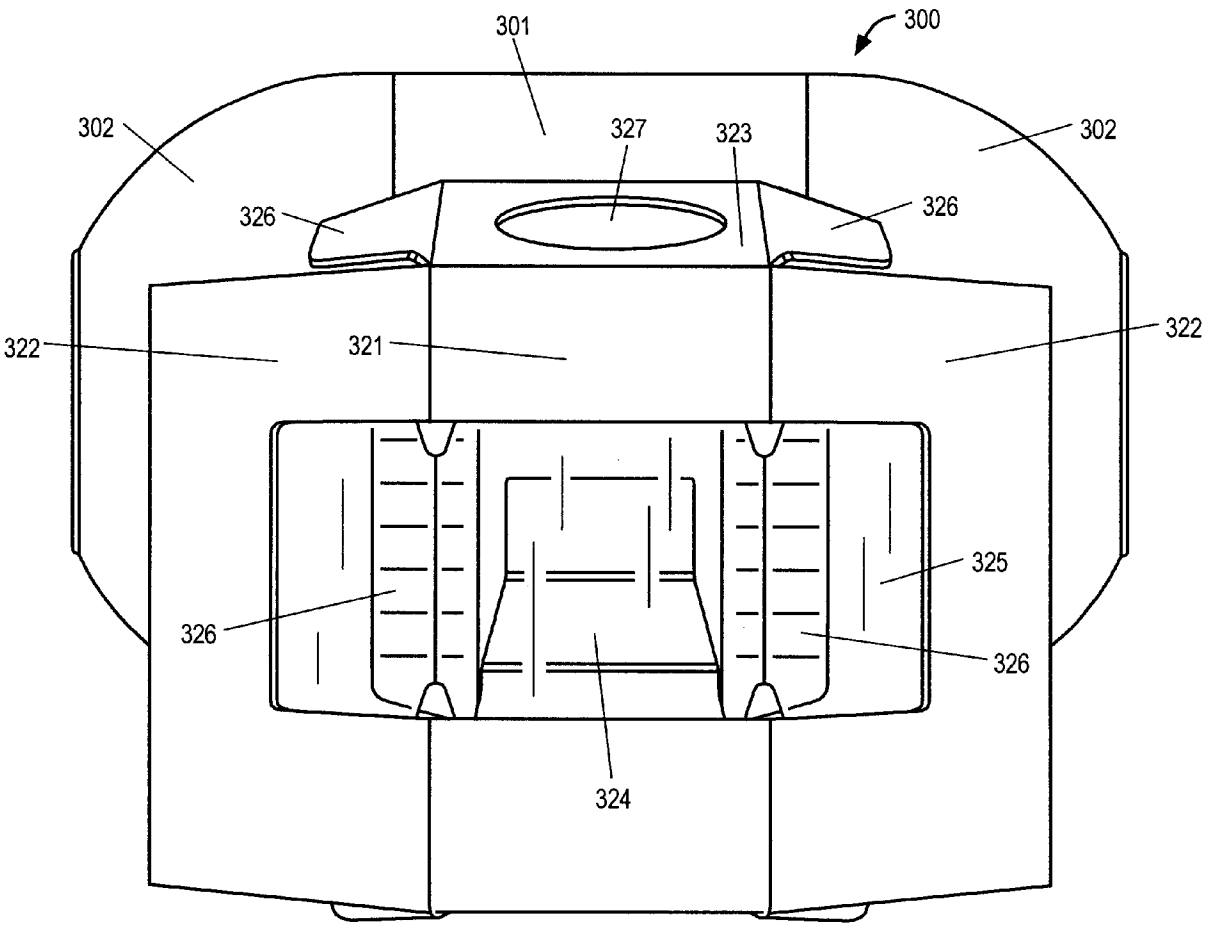
FIGS. 34-38 respectively are front, rear, top, first side, and second side views of a partially assembled inner portion of an alternative package, according to an embodiment of the present invention.
Figure 35:
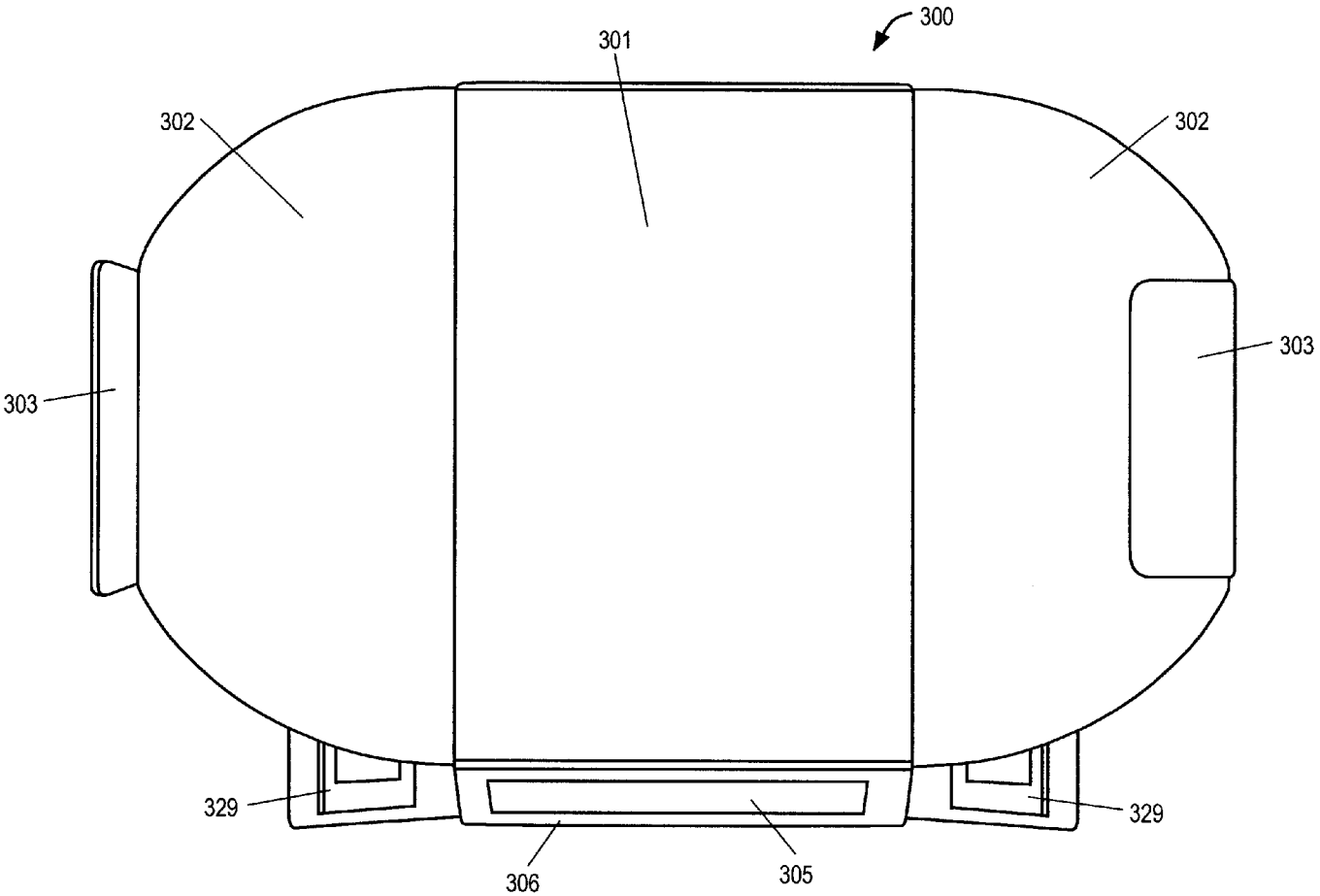
Figure 36:
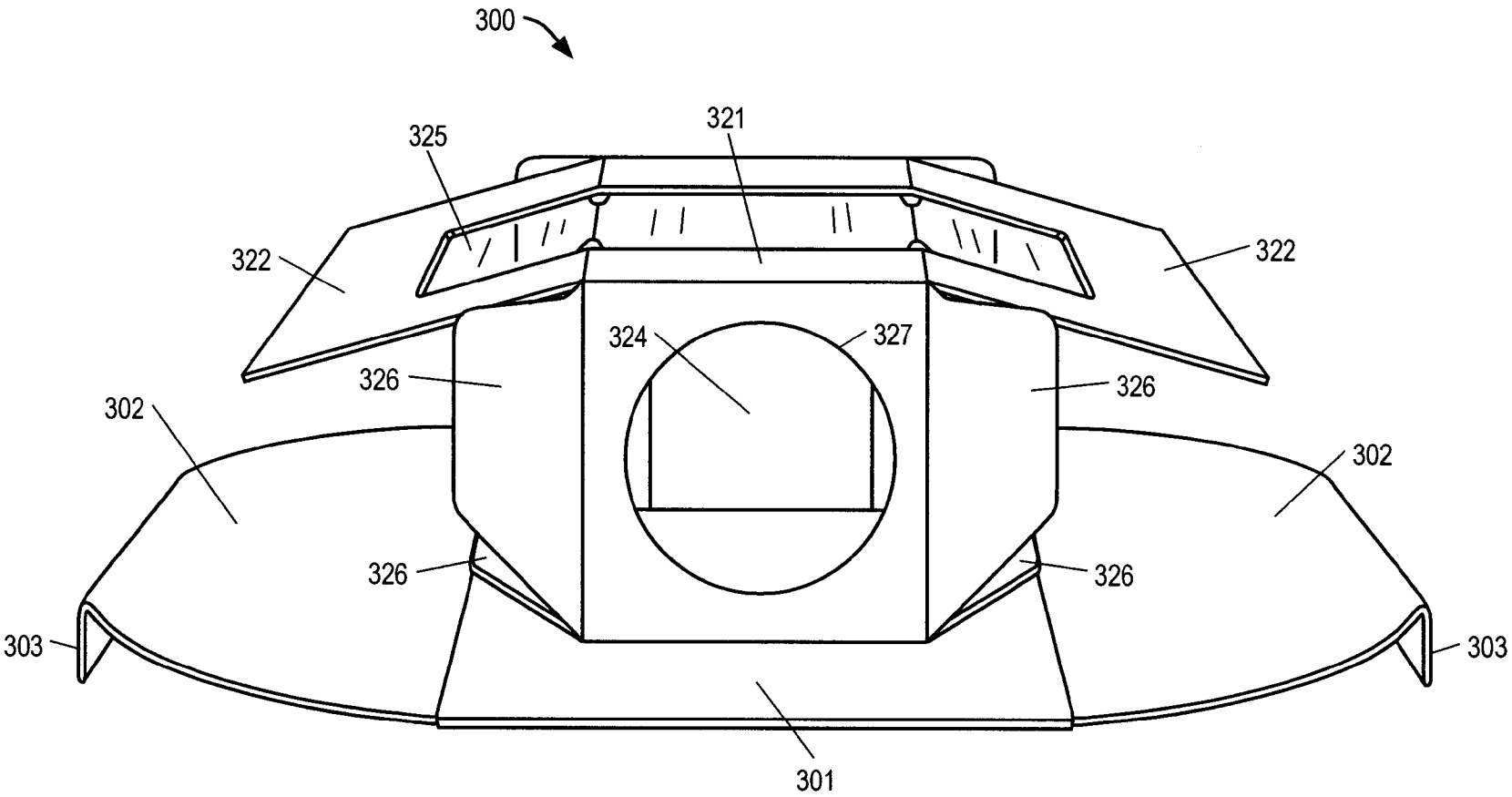
Figure 38:
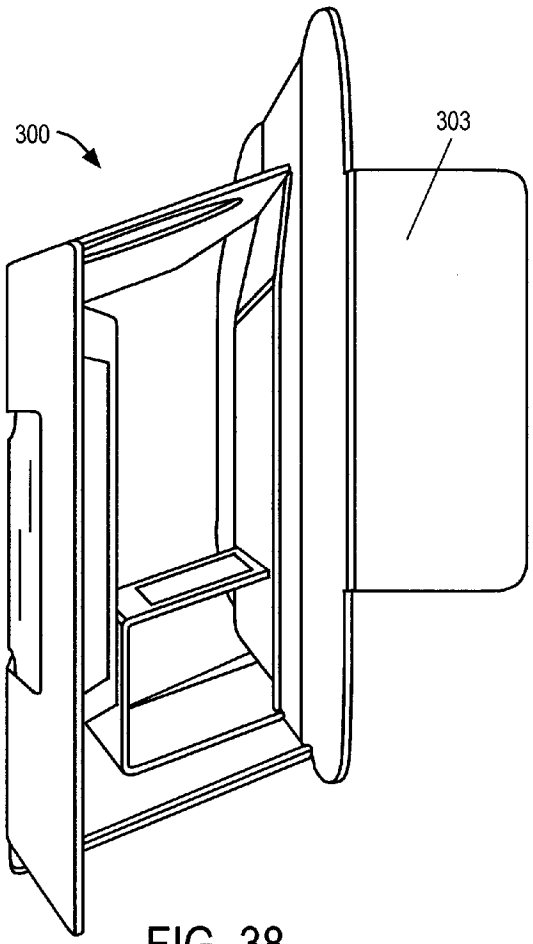
Figure 37:
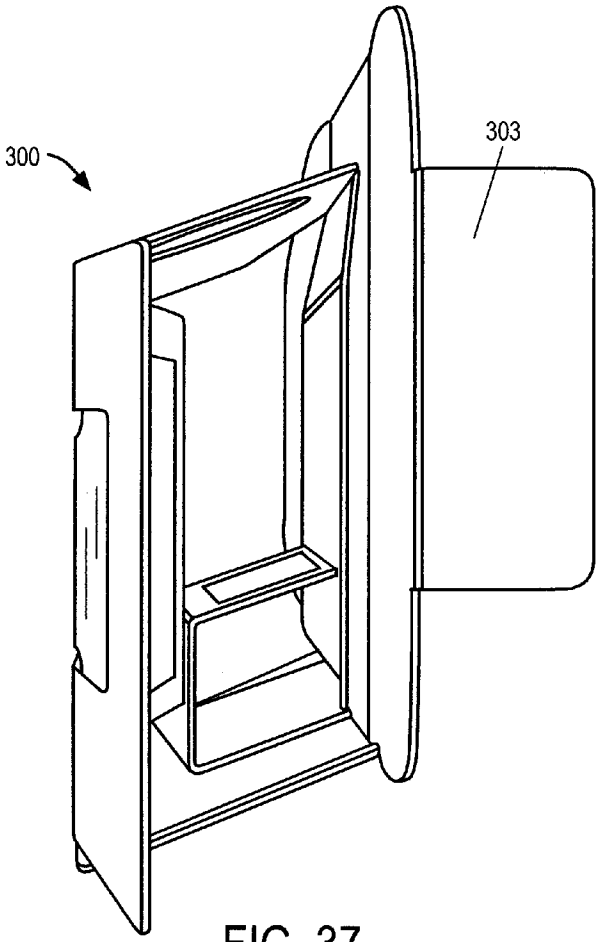

As perhaps best seen in FIG. 33, when the inner portion 300 is slid into the outer portion 400, the substantially rectangular flaps 303 travel past the substantially semicircular shaped slits 406, and the ends 328 of the flaps 303 engage the slits 406 thereby holding the inner portion 300 inside of the outer portion 400. The slits 406 and flaps 407 are part of reusable locking system that works with the flaps 303 of the cooperating portion sides 302 to secure the inner portion 300 to the outer portion 400 in an embodiment of the present invention. In a preferred embodiment of the present invention, to remove the inner portion 300 from the outer portion 400, a user simultaneously presses the substantially semicircular flaps 407 on the outer portion 400, which then presses the substantially rectangular flaps 303 toward the cooperating portion sides 302 of the inner portion 300 and out of engagement with the substantially semicircular shaped slits 406. A user may then slide the inner portion 300 out from the outer portion 400. In an embodiment of the present invention, a user may not remove the inner portion 300 from the outer portion 400 without pressing the flaps 407. In another embodiment of the present invention, simply pulling the exposed portion of the cooperating portion sides 302 of the inner portion 300 with ample force will remove the inner portion 300 from the outer portion 400.

Figure 39:
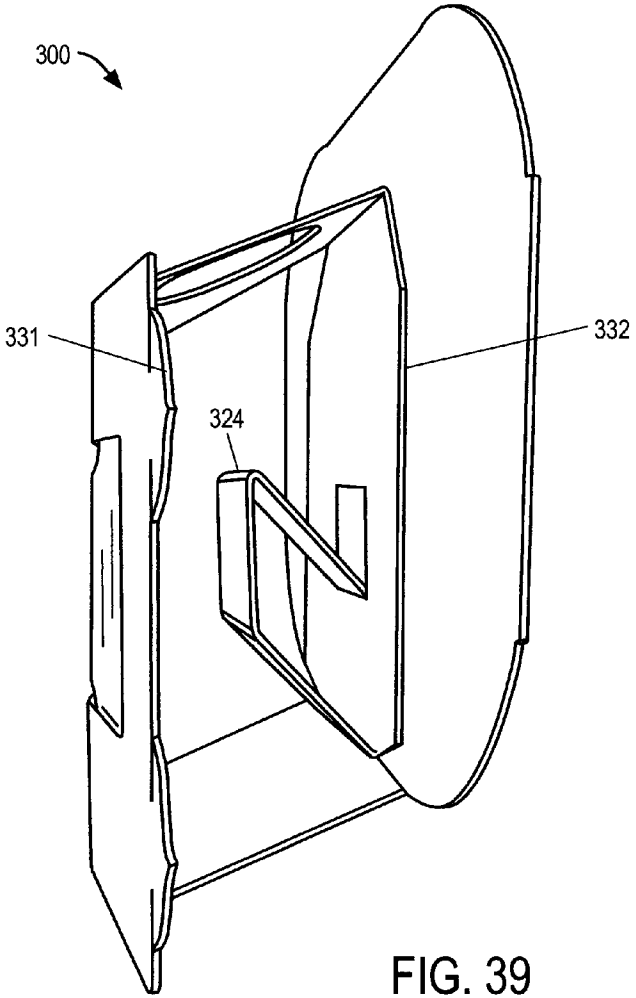
FIGS. 39-41 respectively are side, top, and rear views of an alternative partially assembled inner portion of an alternative package, according to an embodiment of the present invention.
Figure 40:
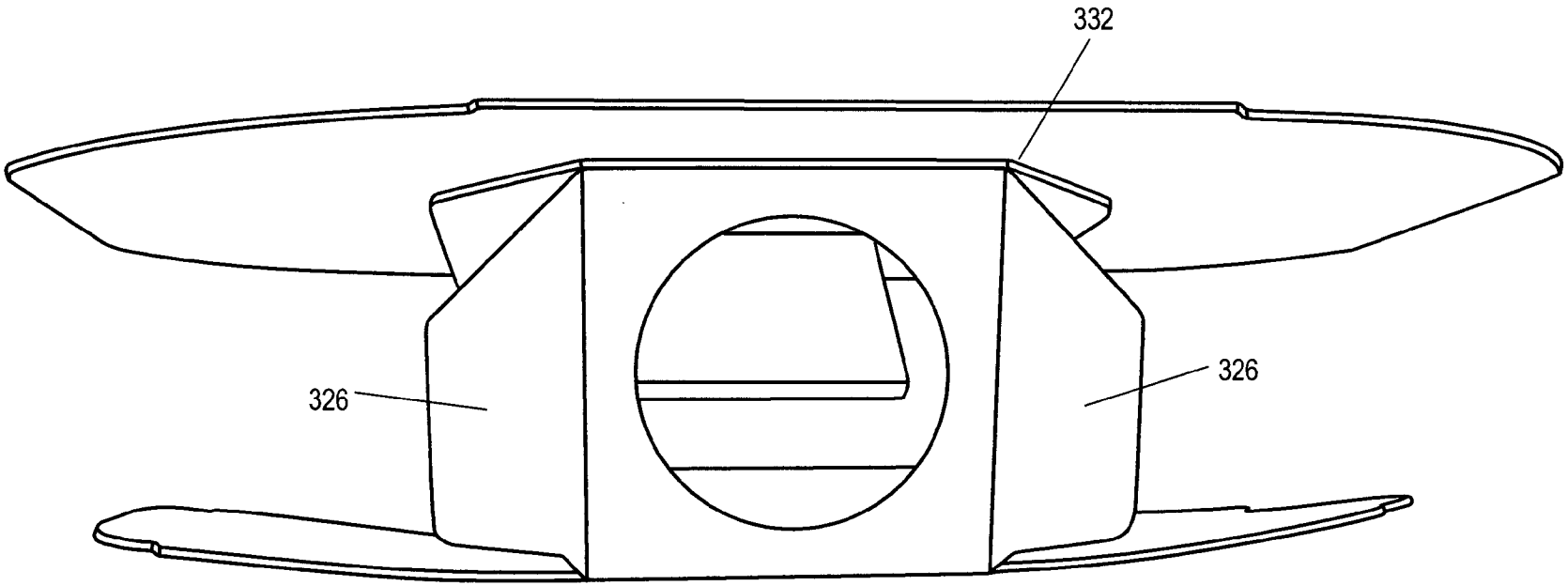
Figure 41:
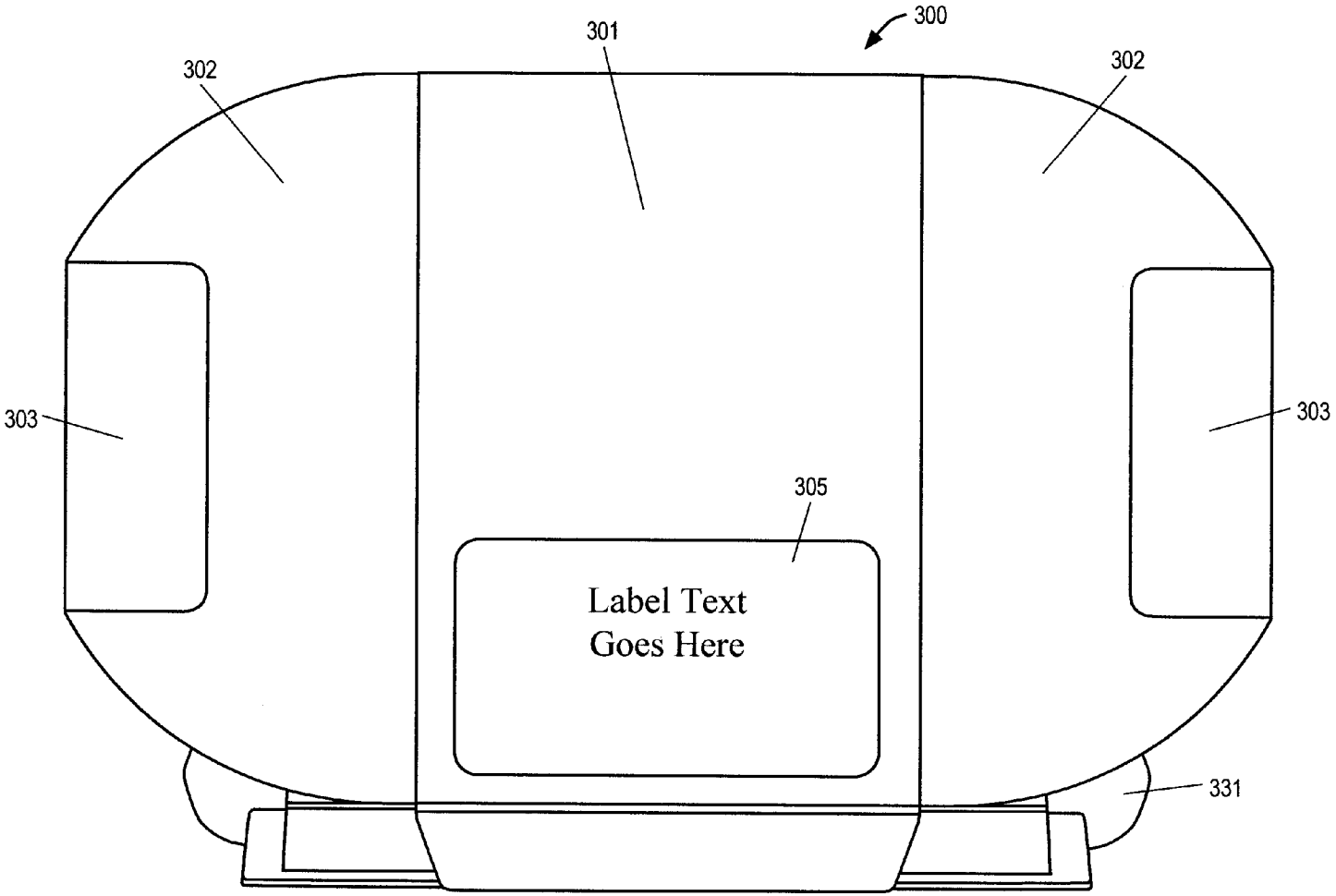

FIGS. 39-41 depict an inner portion 300 constructed in accordance with yet another embodiment of the present invention. The inner portion 300, shown in various states of partial assembly in these figures, includes vial holding portion sides 322 that have tabs 331 that fit into slots 332 on the rear of the vial holding portion 320 in order to create the shape of the vial holding portion 320. In other words, the sides 322 of the vial holding portion 320 in this embodiment are not secured onto extensions in order to form a substantially rectangular box shape, but are instead secured via the tabs 331 being inserted into slots 332. In an embodiment of the present invention, the tabs 331 may be part of a dagger locking mechanism, where the tabs 331 are dagger locking tabs and the slots 332 are designed to accept the dagger locking tabs. Additionally, the embodiment of the present invention shown in FIGS. 39-41 optionally includes a metallic-appearing laminated finish, although one skilled in the art will recognize that the appearance and finish of the packagings described herein is not limited by what is shown in the figures. Moreover, the embodiment of the present invention shown in FIGS. 39-41 optionally includes a label 305 located on the rear 301 of the inner portion 300. One skilled in the art will recognize that a label may be affixed to many portions of embodiments of the present invention and the label location is not limited to the locations shown/described herein.

Figure 42:
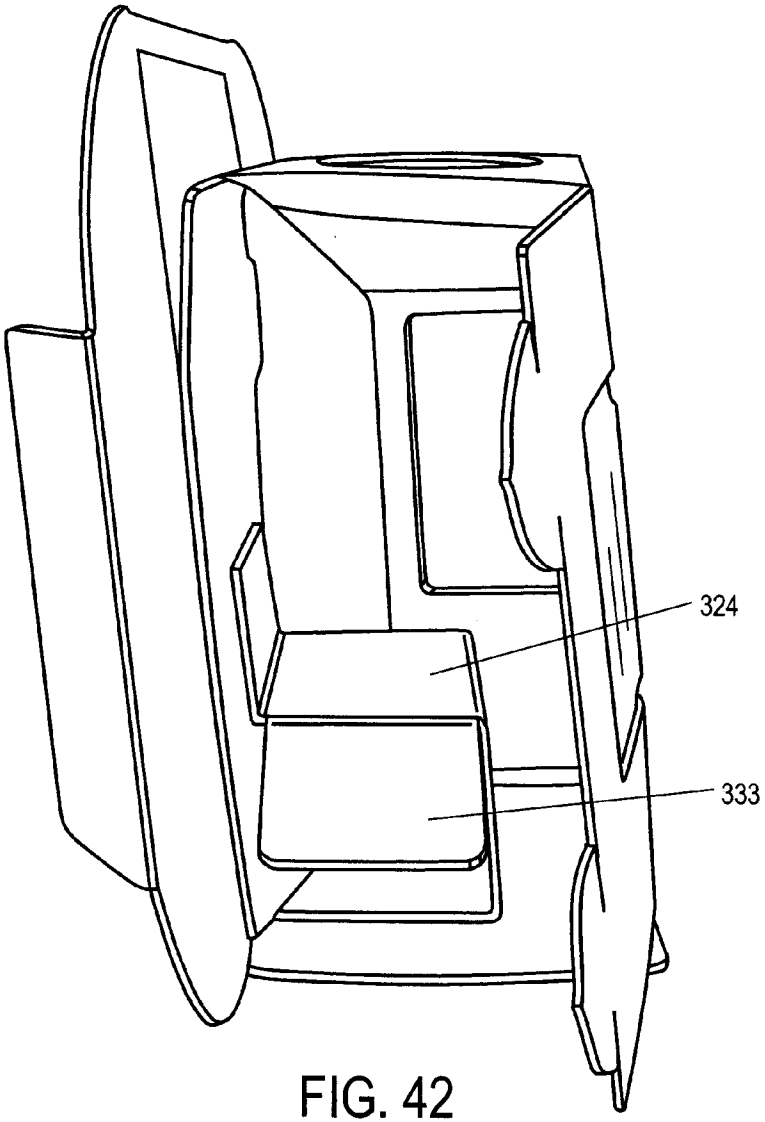
FIGS. 42-44 are side and perspective views of another partially assembled alternative inner portion of an alternative package, according to an embodiment of the present invention.
Figure 43:
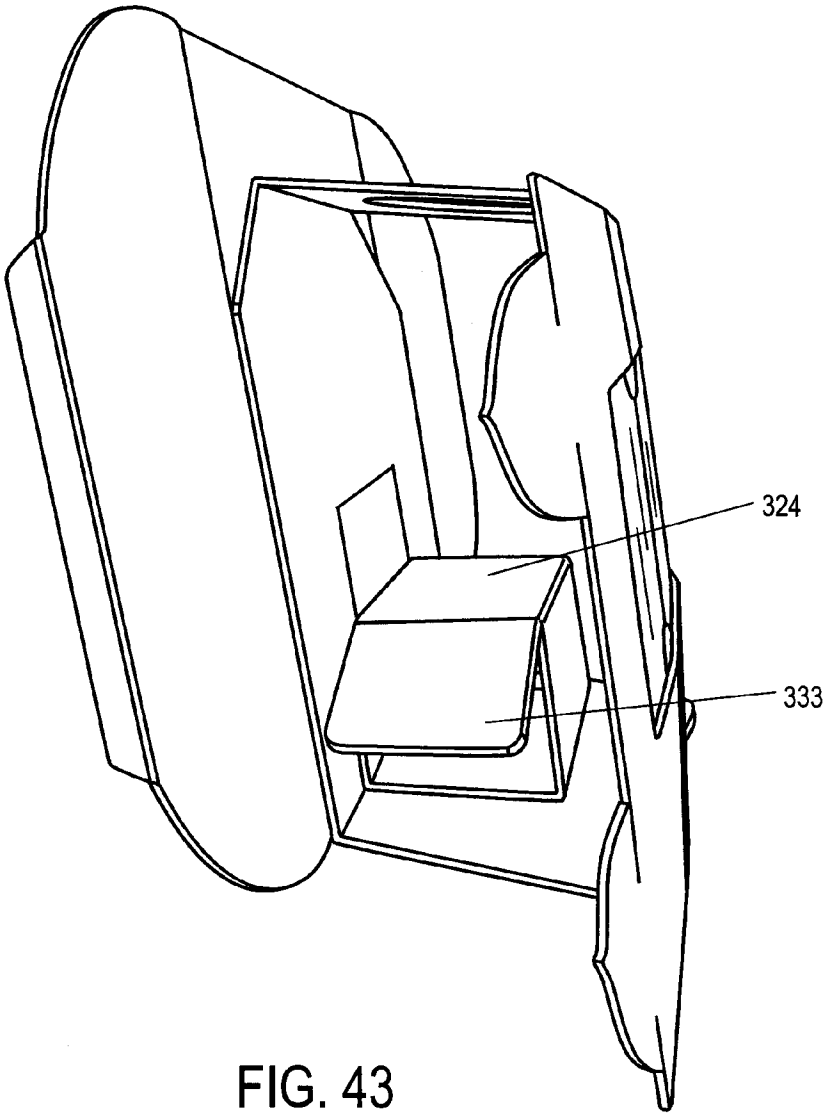
Figure 44:
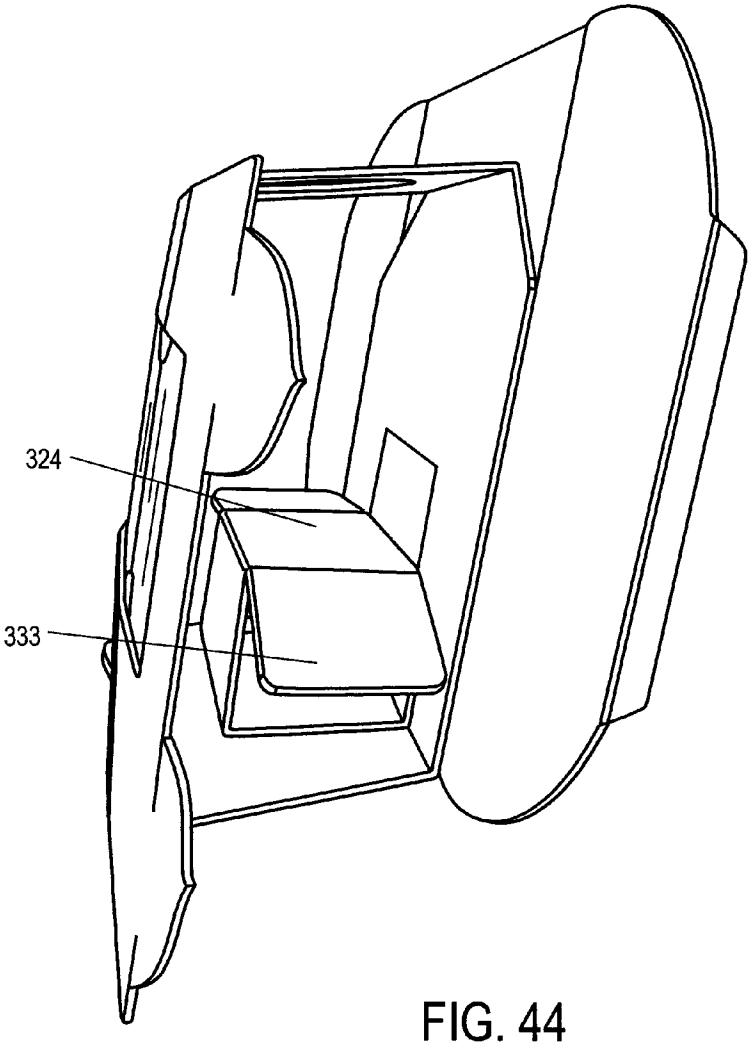

FIGS. 42-44 depict a partially assembled inner portion 300 constructed in accordance with another embodiment of the present invention that is similar to the embodiment shown in FIGS. 39-41, but also includes additional support structures on the vial support 324 in the form of vertical support flaps 333. The vertical support flaps 333 are located on both sides of the vial support 324 to enhance the strength of the vial support 324. The vertical support flaps 333 are in the form of vertical fold-down flaps that provide added strength/support when engaged and locked into place when the inner portion 300 of the package 21 is erected/assembled and the vial holding portion sides 322 are assembled using the tabs 331 and slots 332 and/or the extensions 326 or the like. A person of ordinary skill will recognize that any suitable embodiment of the present invention may include vertical support flaps 333 to assist in strengthening the vial support 324, and the vertical support flaps 333 are not limited to the embodiment shown in FIGS. 42-44.

An embodiment of the present invention is designed so that it can be shipped to a vendor as two substantially flat components (the inner portion 300 and the outer portion 400), which may then be assembled to form the package 21. Embodiments of the present invention may include specific training and support materials so that a packaging vendor can utilize the two flat components and form the package 21.

FIGS. 34-41 depict the inner portion 300 of the package 21 in a semi-assembled state. The vial 23 is placed into the vial holding portion 320 of the inner portion 300 through openings in the side 322 of the vial holding portion 320 (before the sides 322 of the vial holding portion 320 are secured in place forming a substantially rectangular box shape).

Figure 21:
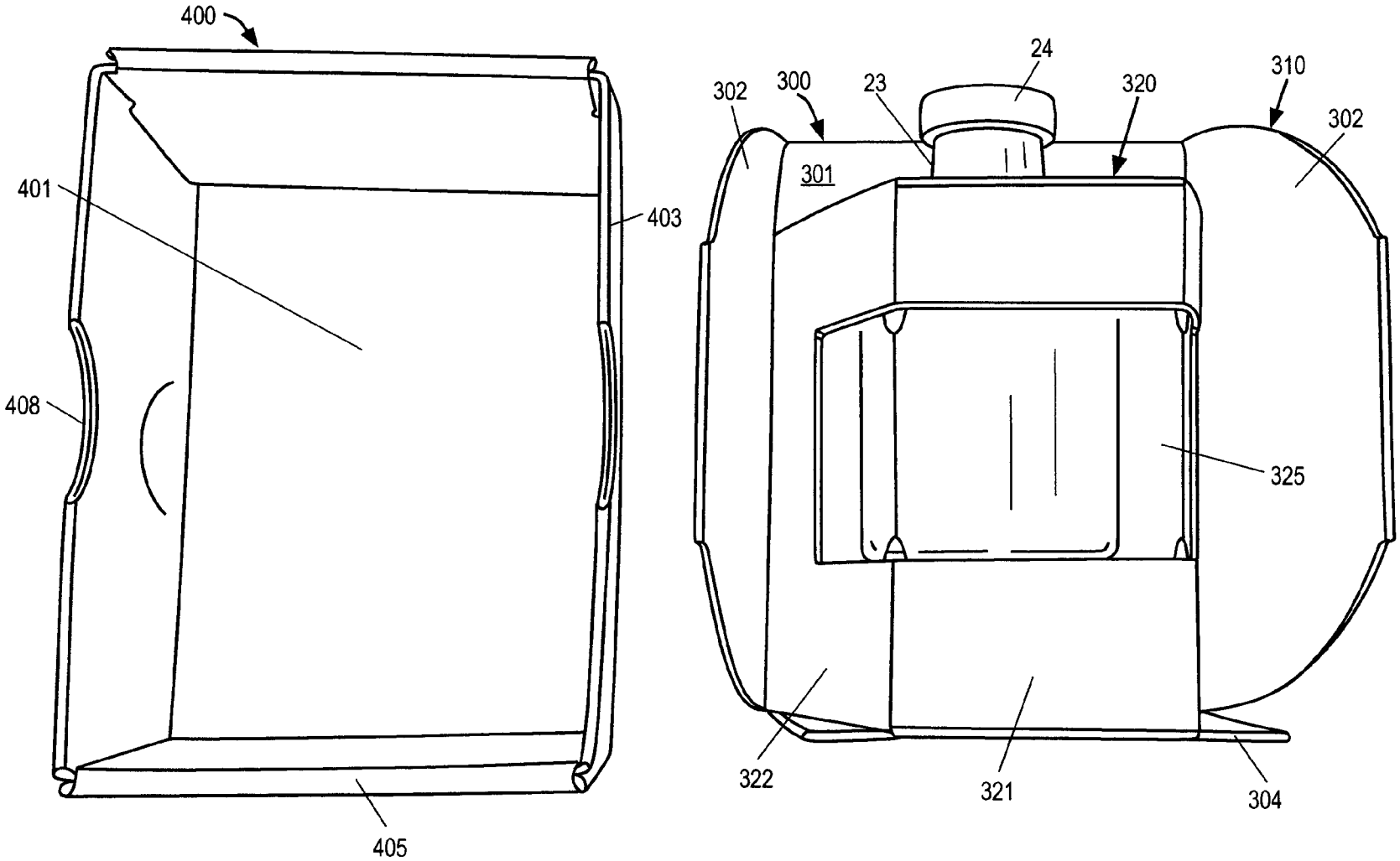
FIG. 21 is a front view of an inner portion and an outer portion of an alternative package positioned near one another before the inner portion is slid into the outer portion, according to an embodiment of the present invention.
Figure 23:
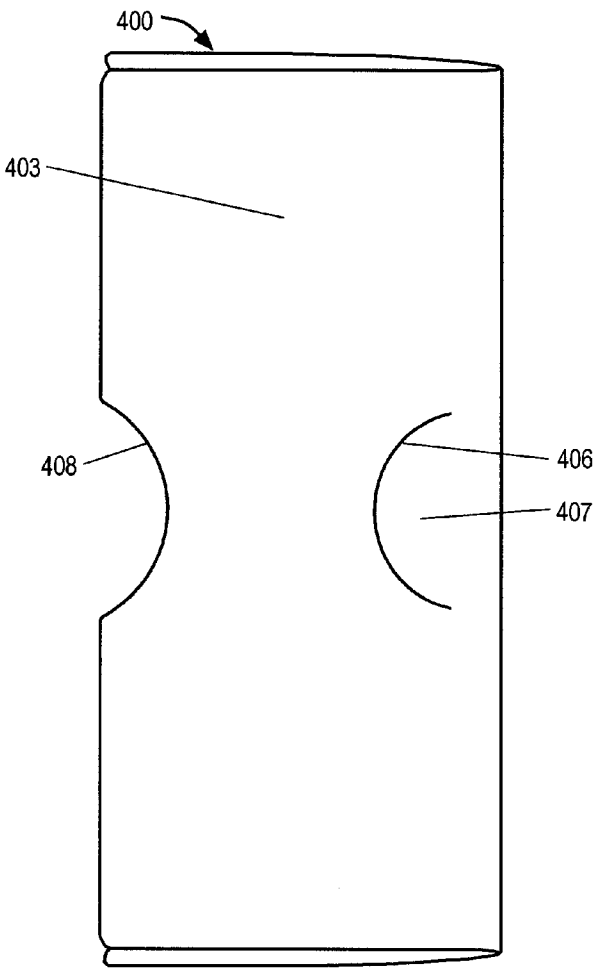
FIGS. 22-24 respectively are first side, second side, and rear perspective views of an outer portion of an alternative package, according to an embodiment of the present invention.
Figure 22:
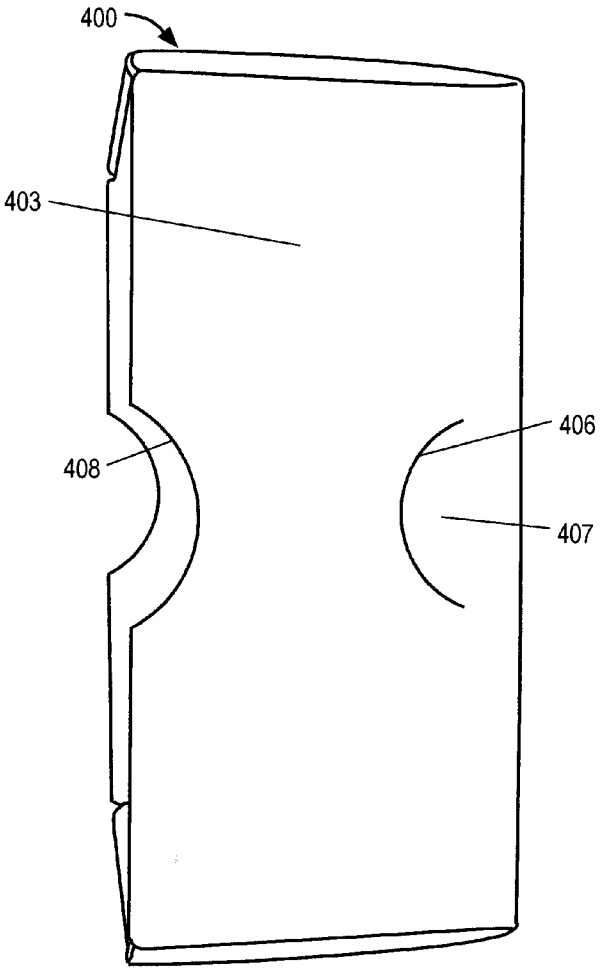

FIG. 21 depicts the inner portion 300 removed from the outer portion 400.

Figure 24:
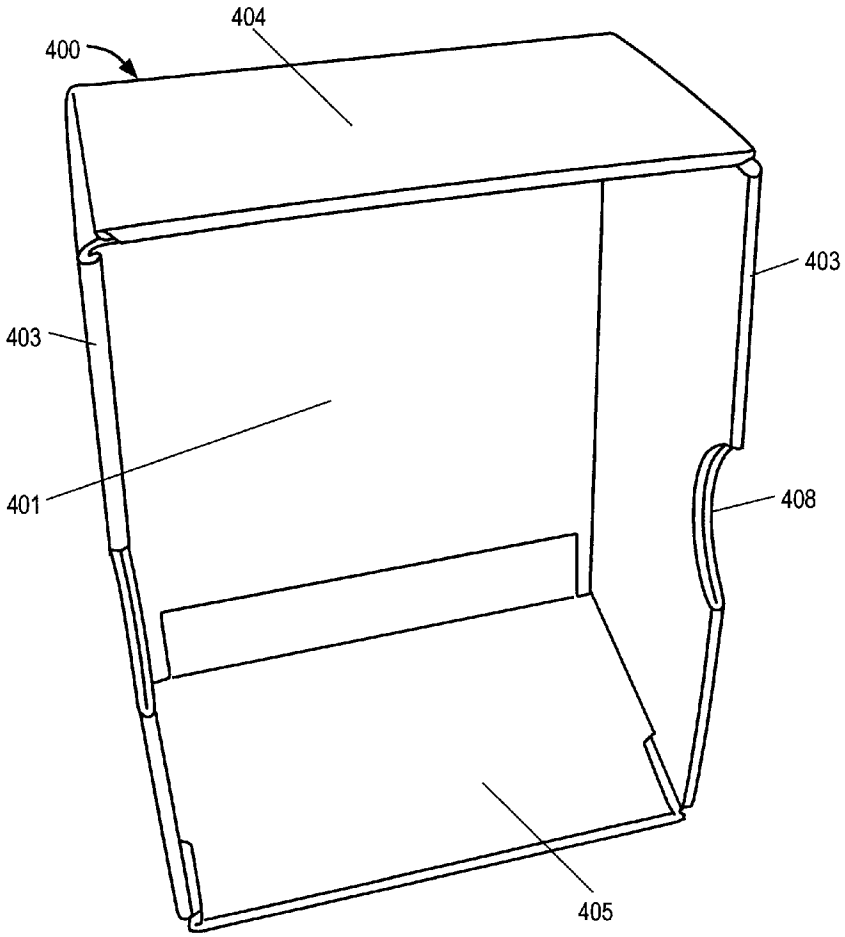
Figure 25:
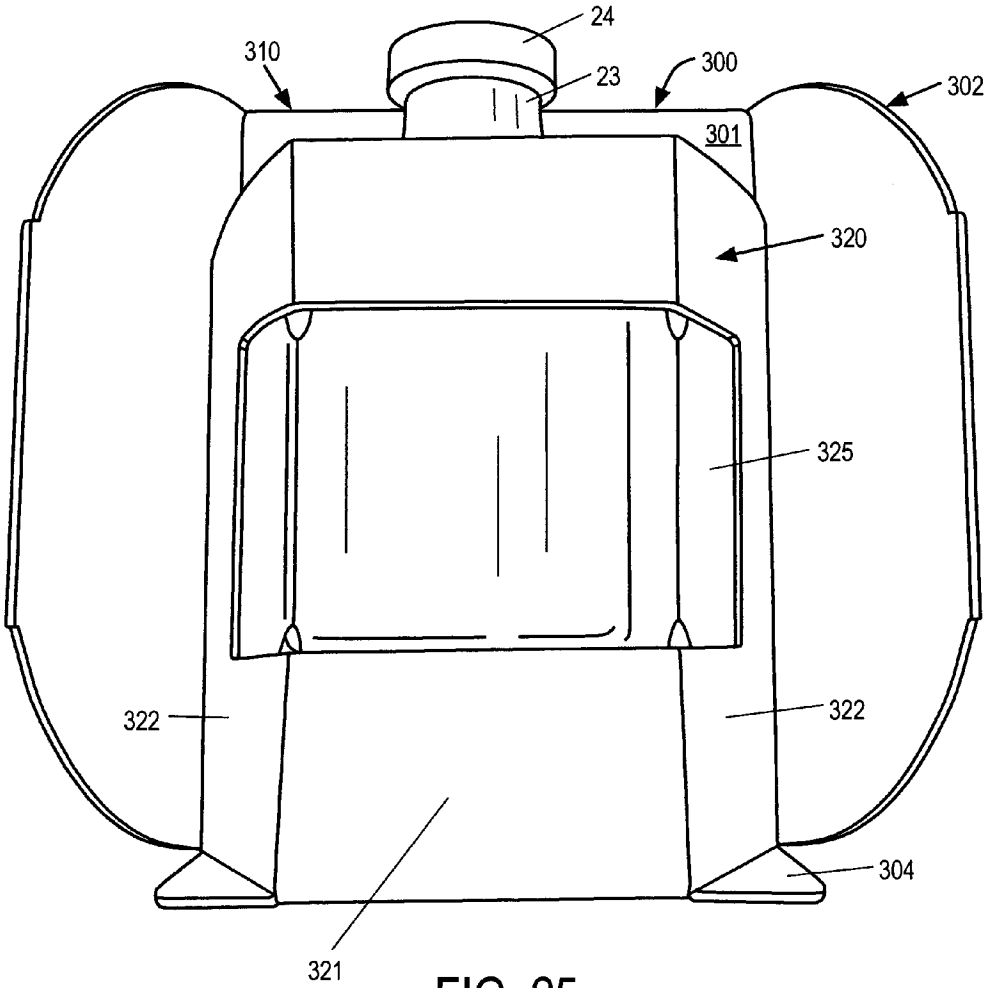
FIGS. 25 and 26 respectively are front and bottom perspective views of an inner portion of an alternative package having a vial disposed therein, according to an embodiment of the present invention.

As depicted in FIG. 24, in an embodiment of the present invention, the outer portion 400 is made from one solitary piece that is folded over itself for enhanced strength. The inner portion 300 may be similarly constructed.

In embodiments of the present invention, one skilled in the art will readily understand that other types of adhesives may be used other than tape or glue to hold the package 21 in the correct shape. Additionally, other securing means may be used altogether, such as clips, docking means, buttons, tabs, friction fits, hook and loop, joint fit, wedge fit, and the like.

As shown in FIG. 33, in an embodiment of the present invention, the inner portion 300 slides into the outer portion 400. An embodiment of the present invention may include a locking feature on the outer portion 400 to prevent the inner portion 300 from inadvertently falling out. The locking feature may be the flaps 303, 407 and slits 406 explained herein, or any other means known to a person of ordinary skill in the art, such as an adhesive, a flap, a latch, a notch, tabs, a punch, or the like.

Embodiments of the present invention may include tape panels 329 as a means for adhering to the desired shape of the package 21. The tape panels 329 may include an aggressive tamper evident tape/adhesive that acts to effectively seal the inner portion 300 in its desired configuration. In an embodiment of the present invention, the only way to remove the vial 23 is to destroy the inner portion 300.

Embodiments of the present invention also include the methods of making the packages described herein, as well as the methods of using the packages in supplying clinical or commercial sites and the like.

While preferred embodiments of the invention are described herein, it will be apparent to one skilled in the art that various changes and modifications may be made. For example, although embodiments of the present invention offer advantages when used for shipping to clinical sites for use in clinical trials, one skilled in the art will understand that the embodiments of the present invention may also be used for other purposes, including but not limited to commercial use. The appended claims are intended to cover all such changes and modifications that fall within the true spirit and scope of the invention.

LIST OF REFERENCE NUMBERS INCLUDED IN FIGURES

The following is a list of reference numbers used in the attached Figures for embodiments of the present invention:

(1) Package
(2) Label
(2a) Booklet
(3) Vial
(4) Protocol ID
(5) Lot ID
(6) Medication ID
(7) Subject ID
(8) Date
(9) Barcode
(10) Cap Protector
(11) Indented Portion
(12) Vial Top
(21) Package
(22) Label
(23) Vial
(24) Vial Top
(100) Inner Portion
(101) Front Portion
(102) Back Portion
(103) Side Portion
(104) Top Portion
(105) Bottom Portion
(106) Large Top Aperture
(107) Small Top Aperture
(108) Top Flap
(110) Vial Support
(111) Vial Label Viewing Aperture
(112) Side Tab Aperture
(113) Side Tab
(114) Tape Panel
(200) Outer Portion
(202) Back Portion
(203) Side Portion
(204) Top Portion
(205) Bottom Portion
(207) Cutout
(300) Inner Portion
(301) Rear
(302) Cooperating Portion Side
(303) Flaps
(304) Base
(305) Label
(306) Bottom Surface
(310) Cooperating Portion
(320) Vial Holding Portion
(321) Front
(322) Vial Holding Portion Side
(323) Top
(324) Vial Support
(325) Viewing Window
(326) Extensions
(327) Top Aperture
(328) Ends (Flaps)
(329) Tape Panel
(330) Foam Glue Composite
(331) Tabs
(332) Slots
(333) Vertical Flaps
(333') Alternative Vertical Flaps
(400) Outer Portion
(401) Cavity
(402) Front Surface
(403) Side Surface
(404) Top Surface
(405) Bottom Surface
(406) Slits -continued

| |
|---|
| (407) Flaps |
| (408) Cutout |

We claim:

1. A package for receiving a vial, the package comprising:

an inner portion constructed out of a first piece of material folded into a first shape configured to receive the vial therein;

an outer portion constructed out of a second piece of material folded into a second shape configured to removably receive the first shape of the inner portion, the outer portion defining an opening in at least the second shape; and an identifying mark or label disposed on the inner portion and being viewable via the opening when the first shape of the inner portion is disposed within the second shape of the outer portion.

2. The package of claim 1, wherein the inner portion comprises a top portion, a bottom portion, and first and second side portions that define a first aperture configured to receive the vial, and a top flap securable to at least one of the top portion and the first and second side portions so as to retain the vial within the first aperture, the top flap having defined therein a second aperture configured to permit access to contents of the vial without removing the vial from the inner portion.

3. The package of claim 2, wherein the second aperture has a diameter selected to permit a top of the vial to protrude therethrough.

4. The package of claim 1, wherein a side aperture is defined within a side portion of the inner portion, the vial being viewable through the side aperture.

5. The package of claim 1, further comprising one or more tape panels that seal the inner portion in the first shape so as to evidence tampering with the inner portion.

6. The package of claim 1, wherein the outer portion further comprises side portions that include cutouts to ease in removal of the inner portion from the outer portion.

7. The package of claim 1, wherein an inside of the first shape of the inner portion comprises a vial support configured to stabilize the vial within the inner portion.

8. The package of claim 1, wherein at least one of the inner and outer portions comprises one of a tab, slot, and flap configured to interlock the first shape of the inner portion with the second shape of the outer portion so as to permit partial removal of the inner portion from the outer portion and to inhibit complete removal of the inner portion from the outer portion.

9. The package of claim 1, wherein the inner portion is formed using a single piece of material, and wherein the outer portion is formed using a single piece of material.

10. The package of claim 1, wherein the opening is defined by a window in the outer portion.

11. A package for receiving a vial, the package comprising:

an inner portion constructed out of a first piece of material folded into a first shape configured to receive the vial therein;

an outer portion constructed out of a second piece of material folded into a second shape configured to removably receive the first shape of the inner portion;

an identifying mark or label disposed on the inner portion and being viewable when the first shape of the inner portion is disposed within the second shape of the outer portion; and a separate cap protector configured to be disposed over the inner portion and comprising an indented portion sized to accommodate and protect a top of the vial.

12. A kit for preparing a package for receiving a vial, the kit comprising:

an inner portion that is flat and is foldable into a first shape configured to receive the vial therein; and an outer portion that is flat and is foldable into a second shape configured to removably receive the first shape of the inner portion, the outer portion defining an opening in at least the second shape, the inner portion having an area for receiving an identifying mark or label that is viewable via the opening when the inner and outer portions respectively are folded into the first and second shapes and the first shape is disposed within the second shape so as to form the package.

13. The kit of claim 12, further comprising a cap protector configured to be disposed over the inner portion and comprising an indented portion sized to accommodate and protect a top of the vial.

14. The kit of claim 12, wherein a side aperture is defined within a side portion of the inner portion, the vial being viewable through the side aperture.

15. The kit of claim 12, further comprising one or more tape panels for use in sealing the inner portion in the first shape so as to evidence tampering with the inner portion.

16. The kit of claim 12, wherein the outer portion further comprises side portions that include cutouts to ease in removal of the inner portion from the outer portion.

17. The kit of claim 16, wherein the first shape into which the inner portion is foldable comprises a top portion, a bottom portion, and first and second side portions that define a first aperture configured to receive the vial, and a top flap securable to at least one of the top portion and the first and second side portions so as to retain the vial within the first aperture, the top flap having defined therein a second aperture configured to permit access to contents of the vial without removing the vial from the inner portion.

18. The kit of claim 17, wherein the second aperture has a diameter selected to permit a top of the vial to protrude therethrough.

19. The kit of claim 12, wherein an inside of the first shape of the inner portion comprises a vial support configured to stabilize the vial within the inner portion.

20. The kit of claim 12, wherein at least one of the inner and outer portions comprises one of a tab, slot, and flap configured to interlock the first shape of the inner portion with the second shape of the outer portion so as to permit partial removal of the inner portion from the outer portion and to inhibit complete removal of the inner portion from the outer portion.

21. The kit of claim 12, wherein the inner portion is formed using a single piece of material, and wherein the outer portion is formed using a single piece of material.

22. The kit of claim 12, wherein the opening is defined by a window in the outer portion.

23. A method of packaging a vial, the method comprising:

constructing an inner portion by folding a first piece of material into a first shape configured to receive the vial therein;

disposing the vial within the first shape of the inner portion;

constructing an outer portion by folding a second piece of material into a second shape configured to removably receive the first shape of the inner portion, the outer portion defining an opening in at least the second shape; and inserting the inner portion into the outer portion, the inner portion having an area for receiving an identifying mark or label that is viewable via the opening when the inner and outer portions respectively are folded into the first and second shapes and the first shape is disposed within the second shape so as to form a package.

24. The method of claim 23, wherein the inner portion comprises a top portion, a bottom portion, and first and second side portions that define a first aperture configured to receive the vial, and a top flap, the method comprising securing the top flap to at least one of the top portion and the first and second side portions so as to retain the vial within the first aperture, the top flap having defined therein a second aperture permitting access to contents of the vial without removing the vial from the inner portion.

25. The method of claim 24, wherein the second aperture has a diameter selected to permit a top of the vial to protrude therethrough.

26. The method of claim 23, further comprising disposing a cap protector over the inner portion, the cap protector comprising an indented portion sized to accommodate and protect a top of the vial.

27. The method of claim 23, wherein a side aperture is defined within a side portion of the inner portion, the vial being viewable through the side aperture.

28. The method of claim 23, further comprising sealing the inner portion in the first shape using one or more tape panels that evidence tampering with the inner portion.

29. The method of claim 23, wherein the outer portion further comprises side portions that include cutouts to ease in removal of the inner portion from the outer portion.

30. The method of claim 23, wherein an inside of the first shape of the inner portion comprises a vial support that stabilizes the vial within the inner portion.

31. The method of claim 23, further comprising interlocking the first shape of the inner portion with the second shape of the outer portion with one of a tab, slot, and flap on at least one of the inner and outer portions so as to permit partial removal of the inner portion from the outer portion and to inhibit complete removal of the inner portion from the outer portion.

32. The method of claim 23, wherein the inner portion is formed using a single piece of material, and wherein the outer portion is formed using a single piece of material.

33. The method of claim 23, wherein the opening is defined by a window in the outer portion.

* * * * *